US007365728B2

(12) United States Patent
Tsujino et al.

(10) Patent No.: US 7,365,728 B2
(45) Date of Patent: Apr. 29, 2008

(54) SHIFT REGISTER AND DISPLAY DEVICE

(75) Inventors: Sachio Tsujino, Mie (JP); Shinya Takahashi, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 424 days.

(21) Appl. No.: 10/895,891

(22) Filed: Jul. 22, 2004

(65) Prior Publication Data

US 2005/0017942 A1 Jan. 27, 2005

(30) Foreign Application Priority Data

Jul. 23, 2003 (JP) ..... 2003-200564

(51) Int. Cl.
*G09G 3/36* (2006.01)

(52) U.S. Cl. ..... 345/100; 345/98; 345/99

(58) Field of Classification Search ..... 345/98, 345/99, 100

See application file for complete search history.

(56) References Cited

U.S. PATENT DOCUMENTS 5,282,234 A * 1/1994 Murayama et al. ..... 377/69
5,708,455 A * 1/1998 Maekawa ..... 345/100
6,018,331 A * 1/2000 Ogawa ..... 345/99
6,633,274 B1 * 10/2003 Yokota et al. ..... 345/100
2002/0190767 A1 * 12/2002 Gomm et al. ..... 327/161
2002/0190944 A1 * 12/2002 Morita ..... 345/100

FOREIGN PATENT DOCUMENTS

JP 11-184434 7/1999
JP 2001-249636 9/2001

* cited by examiner

*Primary Examiner*—Amr A. Awad
*Assistant Examiner*—Randal Willis
(74) *Attorney, Agent, or Firm*—Nixon & Vanderhye P.C.

(57) ABSTRACT

A display device is provided with a shift register having a plurality of bistable circuits, each of the bistable circuits being connected to a corresponding scanning line. An RS flip-flop circuit provided in each of the bistable circuits functions as a memory portion for discriminating a start position of a display region for partial display. When partial display is carried out, first, only the RS flip-flop circuit corresponding to the start position of the display region is put into the set state, that is, only the bistable circuit corresponding to the start position of the display region is put into the set state. Moreover, the scanning lines that are connected to the bistable circuits from the start position to the end position are driven sequentially. During this, only the bistable circuit corresponding to the start position is kept in the set state, and the other bistable circuits are kept in the reset state.

11 Claims, 31 Drawing Sheets

SHIFT REGISTER AND DISPLAY DEVICE

BACKGROUND OF THE INVENTION

1. Field of the Invention

The present invention relates to shift registers capable of partial driving in which a pulse is generated from several of an entirety of bistable circuits, as well as to display devices using such a shift register.

2. Description of the Related Art

Conventionally, matrix display devices are known in which a plurality of scanning lines and a plurality of signal lines intersect with one another. Known as such matrix display devices are FPDs (flat panel displays) such as LCDs (liquid crystal displays), PDPs (plasma display panels), EL (electronic luminescence) displays, and FEDs (field emission displays). FPDs can be more easily made thinner and lighter than conventional CRTs (cathode ray tubes), so that they are also used in mobile phones. On the other hand, there is a need for lower power consumption in mobile phones. Therefore, there are also display devices provided with a partial display function with which an image is displayed only on a portion of the display screen.

According to the display device disclosed in JP H11-184434A, a partial display can be realized by providing a scan permission signal and masking such that a selection signal is not outputted to the scanning lines corresponding to a non-displayed portion. However, in this case it is necessary to generate a shift clock corresponding to all scanning lines, regardless of the size of the non-displayed portions, and the clock number of the shift clock is the same for full screen display as for partial display. Therefore, the power consumption is not reduced.

To address this problem, a display device provided with storage circuits corresponding to the scanning lines has been proposed, wherein signals for discriminating whether regions are displayed regions or non-displayed regions are held in the storage circuits, and partial display is performed by driving only the scanning lines corresponding to the displayed regions. According to JP 2001-249636A, the plurality of scanning lines provided in this display device are connected to a scanning line driving circuit. Moreover, for partial display, only a portion of the scanning lines are driven by the scanning line driving circuit. In this case, the clock number of the shift clock that is necessary is equivalent to the number of scanning lines corresponding to the display region.

FIGS. 23A, 23B, 24A and 24B are circuit diagrams showing the configuration of a scanning line driving circuit of a conventional display device. The right end of the signal lines shown in FIG. 23A is connected to the left end of the signal lines shown in FIG. 23B. Similarly, the right end of the signal lines shown in FIG. 23B is connected to the left end of the signal lines shown in FIG. 24A, and the right end of the signal lines shown in FIG. 24A is connected to the left end of the signal lines shown in FIG. 24B. This scanning line driving circuit comprises an m-stage shift register consisting of m bistable circuits 101, as well as in D flip-flop circuits 102. The D flip-flop circuits 102 function as storage circuits for discriminating displayed regions and non-displayed regions.

FIG. 25 is a circuit diagram showing the configuration of the bistable circuits of this scanning line driving circuit. This bistable circuit comprises a D flip-flop circuit 201, an OR circuit 202, a combination circuit 203, and an AND circuit 204. The combination circuit 203 is consist of two AND circuits and one OR circuit.

FIGS. 26 and 27 are timing charts of the scanning line driving circuit in the conventional display device during full screen display. The direction of the passage of time is from left to right in FIG. 26, and then from left to right in FIG. 27. Referring to FIGS. 23 to 27, the following is a description of the operation of the scanning line driving circuit during full screen display.

As shown in FIGS. 26 and 27, during the period of full screen display, the logic level of a partial display selection signal PB is kept High. Therefore, the output signal outputted from the OR circuit 202 in FIG. 25 is High, so that the input signal CLRB of the D flip-flop circuit 201 is Low. As a result, the D flip-flop circuit 201 is not reset.

Let us now consider the bistable circuit SR1 of the first stage. After the scanning line driving circuit start signal GSP becomes High, when the pulse of the shift clock GCK is inputted, the D flip-flop circuit 201 is set and the output signal QO (SR1QO) of the bistable circuit SR1 becomes High. Moreover, by setting the input signal OE at High in synchronization with the shift clock GCK, so that the output signal GL that is outputted from the AND circuit 204 becomes High. That is to say, the scanning line of the first stage is driven (i.e. a selection signal whose logic level is High is outputted to the first scanning line).

Let us now consider the bistable circuit SR2 of the second stage. The input signal QI of the bistable circuit SR2 is the output signal QO (SR1QO) of the bistable circuit SR1 of the first stage. Therefore, as shown in FIG. 26, after the output signal QO (SR1QO) of the bistable circuit SR1 of the first stage has become High, when the pulse of the shift clock GCK is inputted, the D flip-flop circuit 201 of the bistable circuit SR2 of the second stage is set. That is to say, due to the same operation as in the above-described bistable circuit SR1 of the first stage, the output signal QO (SR2QO) and the output signal GL of the bistable circuit of the second stage become High. Thus, the second scanning line is driven.

The bistable circuits SR3 to SRm of the third and following stages are operated in a similar manner as the bistable circuit SR2 of the second stage, and all scanning lines are driven sequentially. Thus, full screen display is realized.

The following is a description of the operation of the scanning line driving circuit during partial display. In the conventional display device, first, the settings in the storage circuits for discriminating displayed regions and non-displayed regions are performed. Then, partial display is carried out by sequentially driving the scanning lines with the bistable circuits corresponding to the storage circuits that have been set to indicate the displayed region. The following is a description for the case that the i-th to j-th scanning lines correspond to the displayed region. It should be noted that, as mentioned before, the D flip-flop circuits 102 function as the storage circuits.

FIGS. 28 and 29 are timing charts of the scanning line driving circuit while setting the storage circuits for partial display. The direction of the passage of time is from left to right in FIG. 28, and then from left to right in FIG. 29. Referring to FIGS. 23A, 23B, 24A, 24B, 25, 28 and 29, the following is a description of the operation of the scanning line driving circuit while setting the storage circuits for partial display.

During the period of setting the storage circuits, the partial display selection signal PB is held a High level, and the storage circuit setting clock MCK and MDI are set to High, as shown in FIG. 28. Here, every time a pulse of the storage circuit setting clock MCK is inputted, the output signals Q of the D flip-flop circuits 102 are inputted as the input signal D into the D flip-flop circuit of the next stage. For this reason, by setting MDI to High as shown in FIG. 28, the D flip-flop circuits DFFi to DFFj of the i-th to the j-th stage are set.

FIGS. 30 and 31 are timing charts of the scanning line driving circuit during partial display. The direction of the passage of time is from left to right in FIG. 30, and then from left to right in FIG. 31. Referring to FIGS. 23A, 23B, 24A, 24B, 25, 30 and 31, the following is a description of the operation of the scanning line driving circuit during partial display.

When the setting of the storage circuits for partial display as described above has finished, the logic level of the partial display selection signal PB is held at Low, as shown in FIGS. 30 and 31. Here, when the scanning line driving circuit start signal GSP is set to High, the output signal QO (SR1QO to SRi-1QO) of the bistable circuits SRQ to SRi−1 of the first to (i−1)-th stage become High. After this, the partial display begins when a pulse of the shift clock GCK is inputted.

In the bistable circuit SRi of the i-th stage, the output signal GL (GLi) that is outputted from the AND circuit 204 and the output signal QO (SRiQO) that is outputted from the combination circuit 203 become High.

In the bistable circuit SRi+1 of the (i+1)-th stage, the input signal QI is the output signal QO of the bistable circuit SRi of the i-th stage, so that when the pulse of the shift clock GCK that is marked "i+1" in FIG. 30 is inputted, the output signal GL (GLi+1) of the bistable circuit SRi+1 of the (i+1)-th stage becomes High. Also for the bistable circuits SRi+2 to SRj of the (i+2)-th to the j-th stage, the same operation as for the bistable circuit SRi+1 of the (i+1)-th stage is performed. As noted above, the output signals GL (GLi to GLj) of the bistable circuits SRi to SRj of the i-th to j-th stage sequentially become High. That is to say, the scanning lines of the i-th to the j-th stage are driven sequentially, and partial display is performed.

With the conventional art as described above, in order to distinguish between bistable circuits driving a signal line and bistable circuits not driving a signal line, a corresponding storage circuit is necessary for each of the bistable circuits within the shift register, so that there is the problem that the circuitry increases in scale. Moreover, when the circuitry increases in scale, the power consumption increases, posing the problem of how to decrease the power consumption.

SUMMARY OF THE INVENTION

It is an object of the present invention to provide a shift register with which a partial shift operation can be realized without providing any special storage circuits, as well as a display device comprising such a shift register, with which the power consumption can be decreased below that of the conventional art.

A shift register according to a first aspect of the present invention comprises:

a plurality of bistable circuits connected in series, each of the bistable circuits having a first state and a second state and outputting a stage output signal of a logic level in accordance with the state of that bistable circuit, and all or some of the plurality of bistable circuits sequentially taking on the first state for a predetermined time each in accordance with a clock signal that is inputted from outside;

a start position setting circuit for keeping the bistable circuit at a start position, which is the bistable circuit specified by a start position instruction signal that is inputted from outside, in the first state; and a reset circuit for setting the bistable circuits other than the bistable circuit at the start position to the second state, after the bistable circuit at an end position, which is the bistable circuit specified by an end position instruction signal that is inputted from outside, has been set to the first state;

wherein, when the bistable circuit at the start position is kept at the first state, the bistable circuits from the start position to the end position are sequentially set to the first state for the predetermined time each in accordance with the clock signal.

With this configuration, the bistable circuit corresponding to the start position is set to the first state, based on the start position instruction signal. Then, in accordance with the clock signal inputted from outside, each of the plurality of bistable circuits is sequentially set to the first state for the predetermined time each. Moreover, after the bistable circuit corresponding to the end position based on the end position instruction signal is set to the first state, all bistable circuits except for the bistable circuit corresponding to the start position are set to the second state. Furthermore, there are no storage circuits provided other than the bistable circuits. Thus, with the configuration that is simpler than in the conventional art, the bistable circuits from the start position to the end position are sequentially set to the first state, and also after the bistable circuit corresponding to the end position is set to the first state, the bistable circuits are again sequentially set to the first state starting with the one corresponding to the start position.

In this shift register, it is preferable that a start signal that is set at a first logic level at a process start at every frame period, which is a cycle of partial driving in which the bistable circuits from the start position to the end position sequentially take on the first state for a predetermined time each in accordance with the clock signal, a start position setting signal for specifying the bistable circuit corresponding to the start position based on the start position instruction signal, and a final-stage reset signal for setting all bistable circuits except for the bistable circuit at the start position to the second state, are inputted from outside;

the start position setting circuit comprises a first logic gate that is provided in each bistable circuit, the first logic gate outputting a signal of the first logic level when both the start position setting signal and a second-subsequent output signal that is outputted by the bistable circuit two stages after that bistable circuit are at the first logic level, and outputting a signal of a second logic level when at least one of the second-subsequent output signal and the start position setting signal is at the second logic level;

the reset circuit comprises a second logic gate that is provided in each bistable circuit, the second logic gate outputting a signal of the first logic level when the final-stage reset signal and a prior-stage state signal that is set at the first or the second logic level depending on whether or not any of the bistable circuits arranged at the stages prior to that bistable circuit is in the first state are both at the first logic level, and outputting a signal of the second logic level when at least one of the prior-stage state signal and the final-stage reset signal is at the second logic level; and each of the bistable circuits:

is set to the first state when the stage output signal that is outputted from the bistable circuit one stage prior to that bistable circuit is at the first logic level;

outputs a signal of the first logic level as the stage output signal of that bistable circuit when the start signal is at the first logic level or the bistable circuit one stage prior to that bistable circuit is in the first state, and that bistable circuit is in the first state, and the clock signal is at the first logic level;

outputs a signal of the first logic level as the prior-stage state signal to be received by the bistable circuit of the stage subsequent to that bistable circuit when the prior-stage state signal that is outputted from the bistable circuit one stage prior to that bistable circuit is at the first logic level, or that bistable circuit is in the first state; and is set to the second state when the first logic gate or the second logic gate within that bistable circuit outputs a signal of the first logic level.

With this configuration, in an ordinary operation state in which the bistable circuits in the shift register are sequentially set to the first state, when the start position setting signal is kept at the first logic level, the bistable circuits are set to the second state by the second-subsequent output signal of the first logic level. Here, in the case where the start position setting signal is set to the second logic level only when the second-subsequent output signal that is inputted into the bistable circuit at the start position is at the first logic level, only the bistable circuit at the start position is kept in the first state. Thus, the bistable circuit corresponding to the start position for partial driving can be discriminated.

Furthermore, each of the bistable circuits outputs the stage output signal of the first logic level when the clock signal of the first logic level is inputted while the start signal is at the first logic level or the bistable circuit one stage prior to that bistable circuit is in the first state, and that bistable circuit is in the first state. With this stage output signal, the bistable circuit of the next stage is set to the first state. Thus, when the start signal is set to the first logic level, the bistable circuits starting with the one at the start position sequentially output the stage output signal of the first logic level, in accordance with the clock signal, and partial driving is started.

Moreover, when the start position setting signal is held at the first logic level during the partial driving, the bistable circuits are set to the second state by the second-subsequent output signal of the first logic level. Here, when the start position setting signal is set to the second logic level only while the second-subsequent output signal inputted into the bistable circuit at the start position is at the first logic level, then only the bistable circuit at the start position is kept in the first state.

And furthermore, the second-subsequent output signal of the first logic level is not inputted into the bistable circuit at the end position and into the bistable circuit one stage prior to the bistable circuit at the end position, and the bistable circuits are set to the second state when the prior-stage state signal and the final-stage reset signal are at the first logic level. Accordingly, when the final-stage reset signal is set to the first logic level after the stage output signal of the first logic level has been outputted from the bistable circuit at the end position, then the bistable circuit at the end position and the bistable circuit one stage prior to the end position are set to the second state. On the other hand, since the prior-stage state signal inputted into the bistable circuit at the start position is at the second logic level, the bistable circuit at the start position is kept in the first state.

Thus, the stage output signal of the first logic level is sequentially outputted by the bistable circuits from the start position to the end position. Moreover, after the stage output signal of the first logic level is outputted by the bistable circuit at the end position, only the bistable circuit at the start position is kept in the first state. For this reason, the stage output signal of the first logic level is repeatedly outputted by the bistable circuits from the start position to the end position, and partial driving is performed.

According to another aspect of the present invention, a display device comprises a scanning line driving circuit for driving a plurality of scanning lines and a signal line driving circuit for driving a plurality of signal lines, the display device having a partial display function in which a portion of a display screen serves as a display region;

at least one of the scanning line driving circuit and the signal line driving circuit comprising a shift register; and the shift register comprising:

a plurality of bistable circuits connected in series, each of the bistable circuits having a first state and a second state and outputting a stage output signal of a logic level in accordance with the state of that bistable circuit, and all or some of the plurality of bistable circuits sequentially taking on the first state for a predetermined time each in accordance with a clock signal that is inputted into the shift register from outside the shift register;

a start position setting circuit for keeping the bistable circuit at a start position, which is the bistable circuit specified by a start position instruction signal that is inputted from outside, in the first state; and a reset circuit for setting the bistable circuits other than the bistable circuit at the start position to the second state, after the bistable circuit at an end position, which is the bistable circuit specified by an end position instruction signal that is inputted into the shift register from outside the shift register, has been set to the first state;

wherein, when the bistable circuit at the start position is kept at the first state, the bistable circuits from the start position to the end position are sequentially set to the first state for the predetermined time each in accordance with the clock signal.

With this configuration, the scanning lines from the start position to the end position in the scanning line driving circuit provided in the display device are driven sequentially, or the signal lines from the start position to the end position in the signal line driving circuit provided in the display device are driven sequentially. In the shift register with which this display device is provided, no storage circuits other than the bistable circuits are provided. Thus, a display device is provided with which partial display is possible with a configuration that is simpler than in the conventional art.

These and other objects, features, aspects and advantages of the present invention will become more apparent from the following detailed description of the present invention when taken in conjunction with the accompanying drawings.

DESCRIPTION OF THE PREFERRED EMBODIMENTS

The following is a description of embodiments of the present invention, with reference to the accompanying drawings.

1 Overall Configuration

Figure 1:
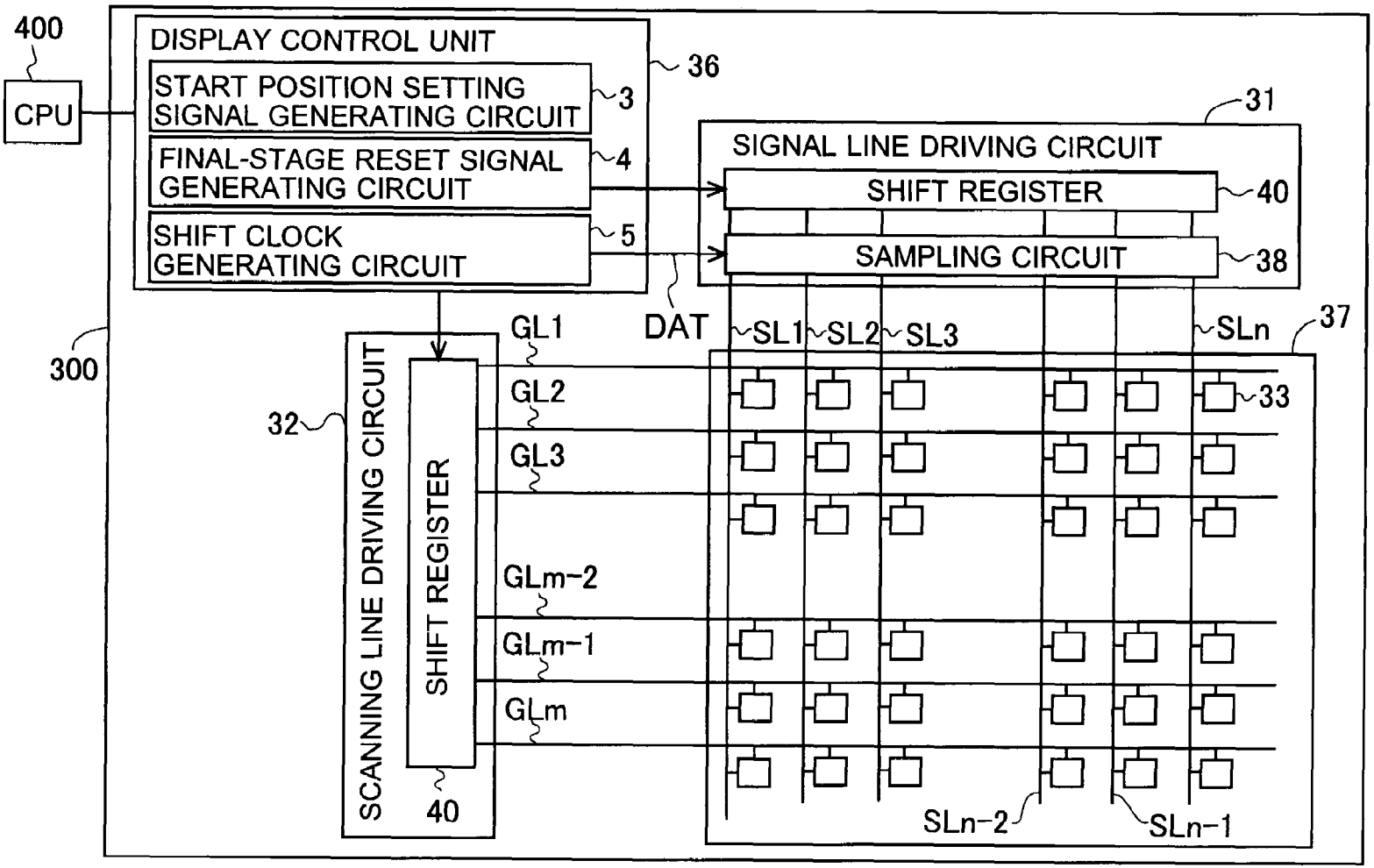
FIG. 1 is a block diagram showing the overall configuration of a display device according to an embodiment of the present invention.

FIG. 1 is a block diagram showing the overall configuration of a display device 300 according to an embodiment of the present invention. This display device 300 includes a display control circuit 36, a scanning line driving circuit 32, a signal line driving circuit 31, and a display panel 37. Within the display panel 37, a plurality of scanning lines GL1 to GLm and a plurality of signal lines SL1 to SLn are disposed in a lattice arrangement, and display elements 33 are provided at positions enclosed by the scanning lines and the signal lines. The scanning lines GL1 to GLm are connected to the scanning line driving circuit 32, whereas the signal lines SL1 to SLn are connected to the signal line driving circuit 31. Moreover, the display control circuit 36 is provided with a start position setting signal generating circuit 3, a final-stage reset signal generating circuit 4, and a shift clock generating circuit 5. It should be noted that the display device 300 that is described here is provided with m scanning lines and n signal lines.

The display control circuit 36 receives image signals or the like from a CPU 400 of an information appliance or the like arranged outside of the display device 300, and outputs image signals and timing signals for displaying an image with the display panel 37. The image signals received by the display control circuit 36 include a display instruction signal, a start position instruction signal and an end position instruction signal. The display instruction signal indicates whether full screen display or partial screen display is performed. The start position instruction signal indicates the start position of the display region when performing partial display. The end position instruction signal indicates the end position of the display region when performing partial display. The scanning line driving circuit 32 receives, for example, timing signals outputted by the display control circuit 36, and outputs selection signals (scanning signals) to the scanning lines GL1 to GLm. The signal line driving circuit 31 receives, for example, image signals DAT and timing signals outputted by the display control circuit 36, and outputs image signals for driving the display panel 37. Thus, by outputting image signals and selection signals from the scanning line driving circuit 32 and the signal line driving circuit 31, a voltage is applied to the electrodes of the display elements 33, and the desired image is displayed on the display panel 37.

The start position setting signal generating circuit 3 and the final-stage reset signal generating circuit 4 generate such signals that the scanning lines from the start position to the end position of the display region are driven. The shift clock generating circuit 5 generates shift clocks GCK1 to GCK4 serving as input signals for the scanning line driving circuit 32. Moreover, the scanning line driving circuit 32 includes a shift register 40 consisting of a plurality of bistable circuits. The plurality of bistable circuits generates signals that are outputted to the scanning lines GL1 to GLm, in accordance with the display instruction signal and the like. The bistable circuits are either in a set state (first state) in which they output a High signal or in a reset state (second state) in which they output a Low signal. Also the signal line driving circuit 31 includes a shift register 40 consisting of a plurality of bistable circuits, just like the scanning line driving circuit 32. The signal line driving circuit 31 is further provided with a sampling circuit 38 for sampling the image signals DAT based on the signals outputted from the shift register 40. It should be noted that the start position setting signal generating circuit 3, the final-stage reset signal generating circuit 4, the shift clock generating circuit 5 and the bistable circuits are discussed in more detail further below.

2. Shift Clock Generating Circuit

Figure 2:
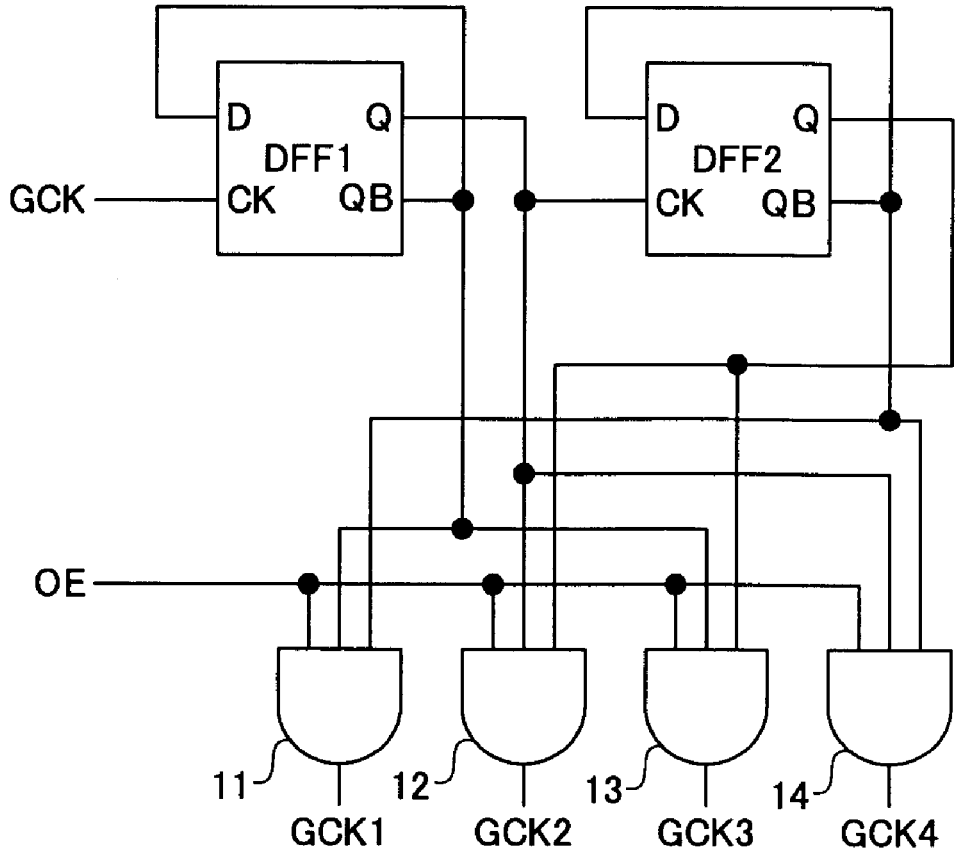
FIG. 2 is a circuit diagram showing the configuration of the shift clock generating circuit of this embodiment.

FIG. 2 is a circuit diagram showing the configuration of the shift clock generating circuit 5. This shift clock generating circuit 5 comprises two D flip-flop circuits DFF1 and DFF2, and four AND gates 11 to 14, and generates shift clocks GCK1 to GCK4, which serve as input signals for the scanning line driving circuit 32 according to the present embodiment, based on the input signals GCK and OE of the conventional scanning line driving circuit 32.

The D flip-flop circuits DFF1 and DFF2 each receive the two input signals D and CK, and output the two output signals Q and QB. The AND gate 11 outputs a signal (shift clock 1) GCK1 that is the logical product of the input signal OE, the output signal QB of the D flip-flop circuit DFF1, and the output signal QB of the D flip-flop circuit DFF2. The AND gate 12 outputs a signal (shift clock 2) GCK2 that is the logical product of the input signal OE, the output signal Q of the D flip-flop circuit DFF1, and the output signal Q of the D flip-flop circuit DFF2. The AND gate 13 outputs a signal (shift clock 3) GCK3 that is the logical product of the input signal OE, the output signal QB of the D flip-flop circuit DFF1, and the output signal Q of the D flip-flop circuit DFF2. The AND gate 14 outputs a signal (shift clock 4) GCK4 that is the logical product of the input signal OE, the output signal Q of the D flip-flop circuit DFF1, and the output signal QB of the D flip-flop circuit DFF2.

The D flip-flop circuits DFF1 and DFF2 both divide the frequency of their respective input signal CK in half. Moreover, the output signal Q of the D flip-flop circuit DFF1 serves as the input signal CK of the D flip-flop circuit DFF2, so that the D flip-flop circuit DFF1 and the D flip-flop circuit DFF2 function as a 4-ary counter.

Figure 3:
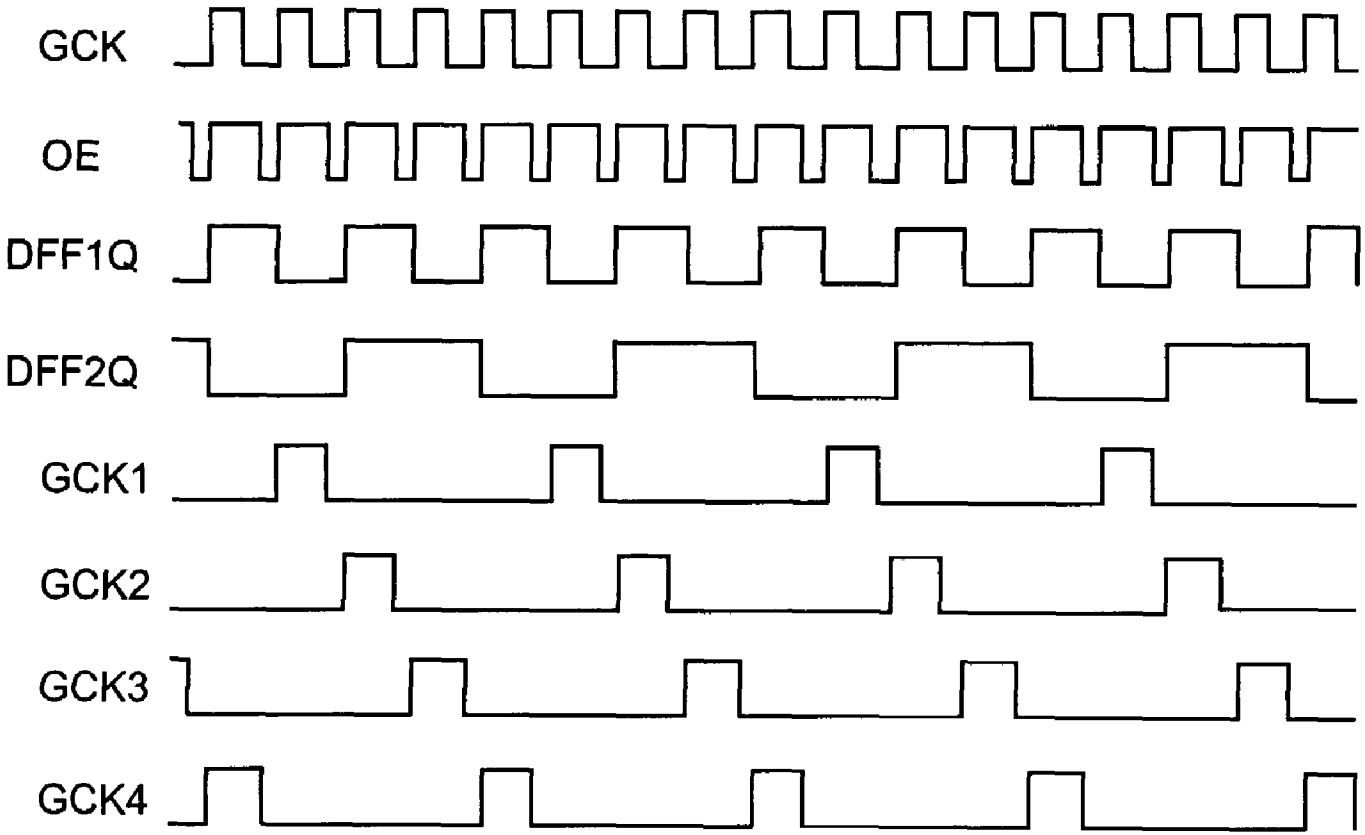
FIG. 3 is a timing chart showing the generation of the shift clocks with the shift clock generating circuit in this embodiment.

FIG. 3 is a timing chart showing the generation of the shift clocks GCK1 to GCK4 with the shift clock generating circuit 5 shown in FIG. 2. This shift clock generating circuit 5 receives the two input signals GCK (shift clock) and OE as shown in FIG. 3. As mentioned before, the D flip-flop circuit DFF1 and the D flip-flop circuit DFF2 of the shift clock generating circuit 5 function as a 4-ary counter, so that every time a pulse of the input signal GCK (shift clock) and the OE shown in FIG. 3 is inputted the signals GCK 4, GCK1, GCK2 and GCK 3 become sequentially High.

Thus, in the shift clock generating circuit 5, shift clocks GCK1 to GCK4 whose logic level sequentially becomes High are generated based on the input signals GCK and OE of the conventional scanning line driving circuit 32. Therefore, shift clocks GCK1 to GCK4 that sequentially become High are inputted into the scanning line driving circuit 32.

3. Scanning Line Driving Circuit

Figure 4A:
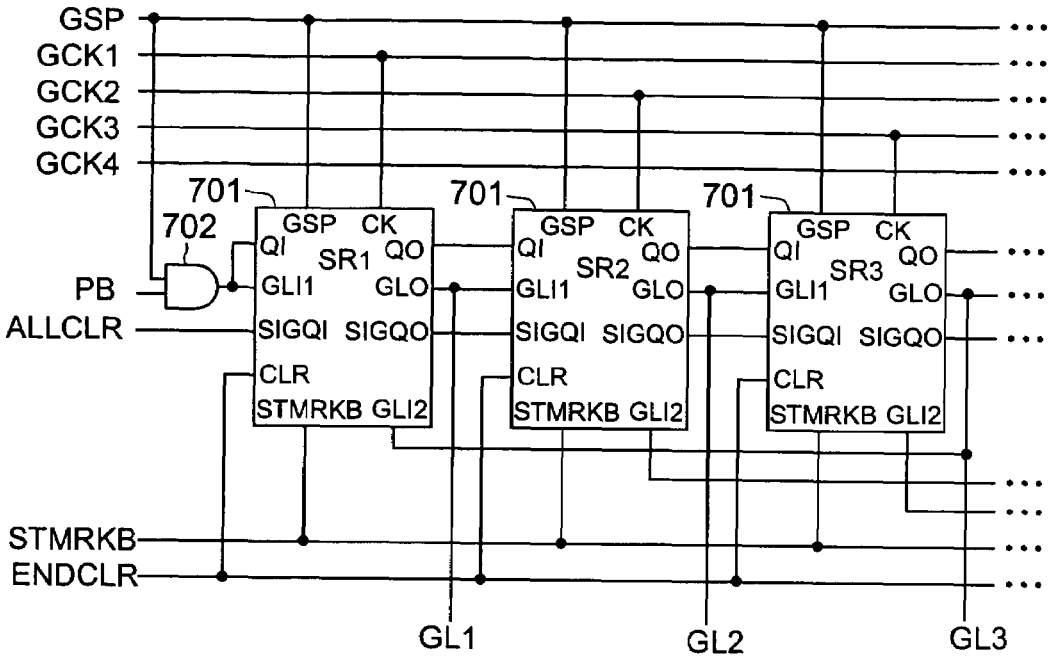
FIGS. 4A and 4B are circuit diagrams showing the configuration of a scanning line driving circuit according to this embodiment.
Figure 4B:
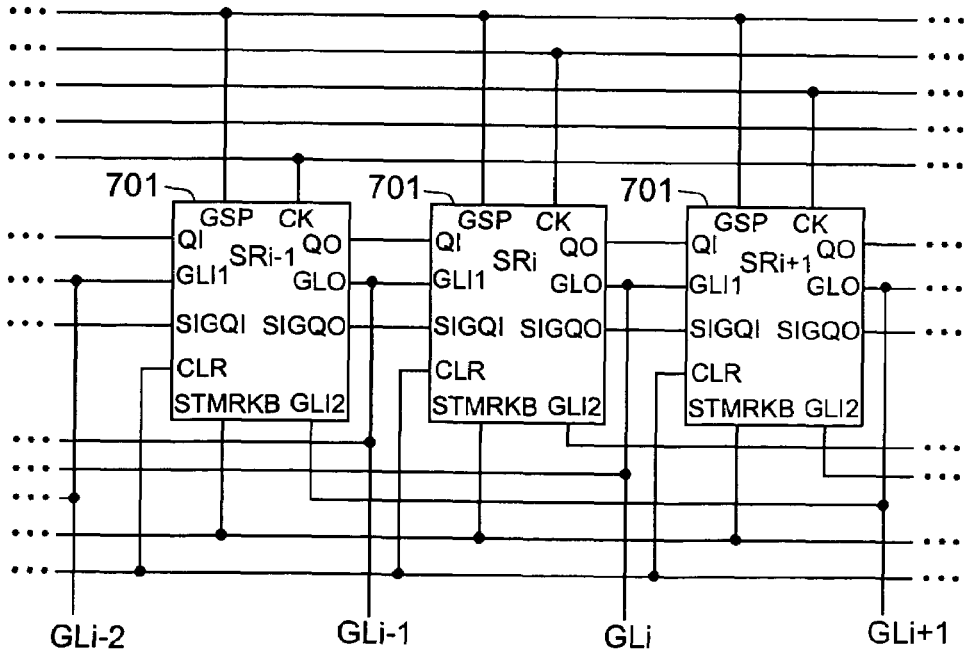
Figure 5A:
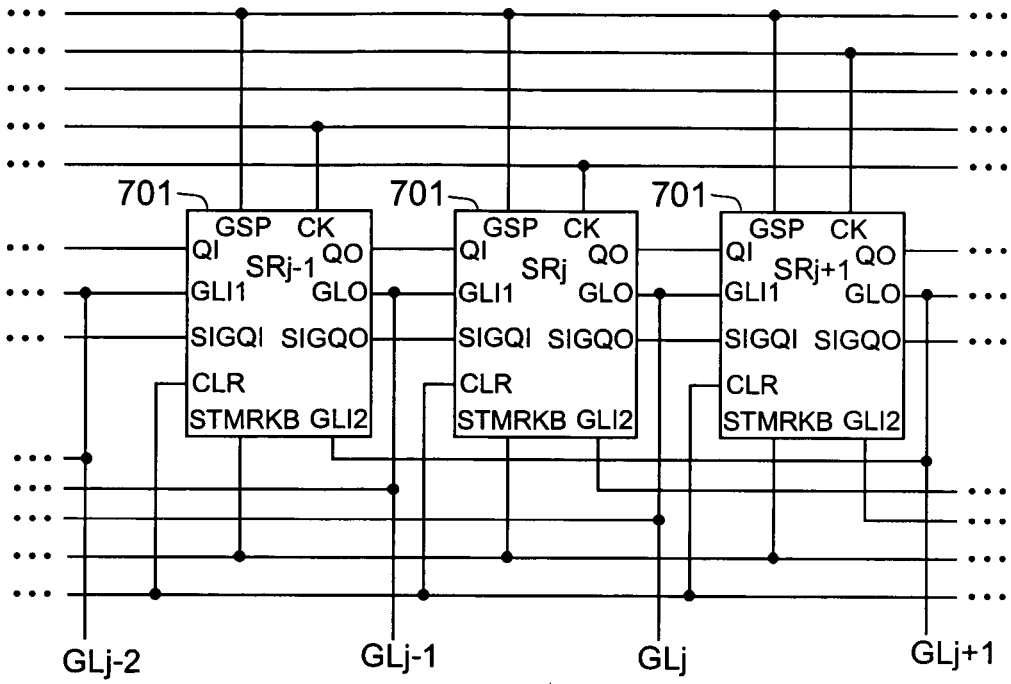
FIGS. 5A and 5B are circuit diagrams showing the configuration of the scanning line driving circuit according to this embodiment.
Figure 5B:
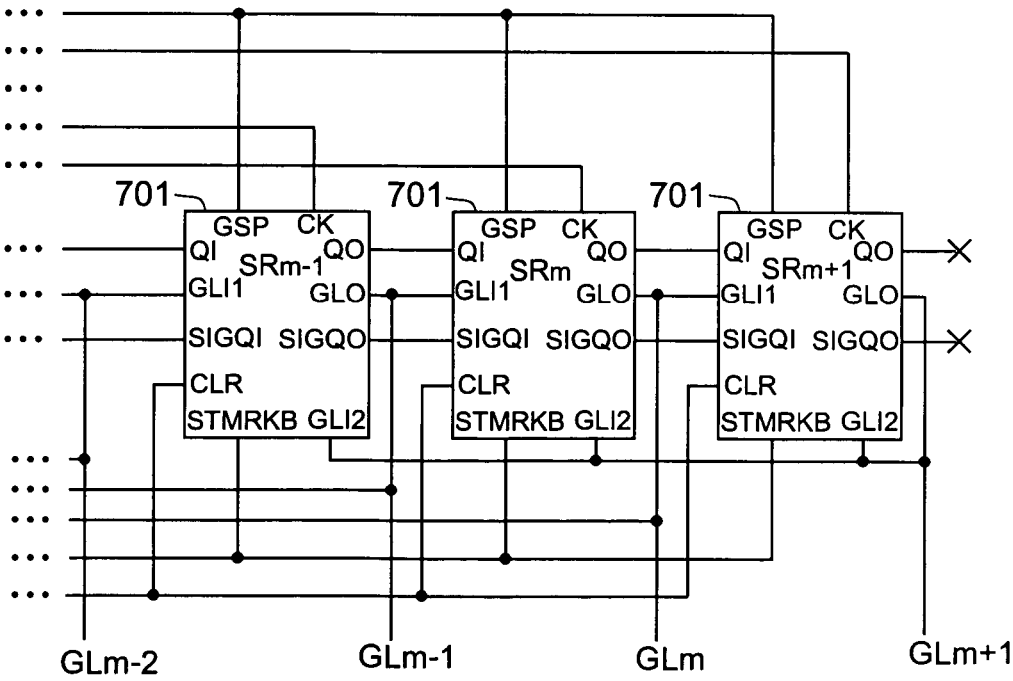

FIGS. 4A, 4B, 5A and 5B are circuit diagrams showing the configuration of the scanning line driving circuit 32 according to the present embodiment. The right end of the signal lines shown in FIG. 4A is connected to the left end of the signal lines shown in FIG. 4B. Similarly, the right end of the signal lines shown in FIG. 4B is connected to the left end of the signal lines shown in FIG. 5A, and the right end of the signal lines shown in FIG. 5A is connected to the left end of the signal lines shown in FIG. 5B. This scanning line driving circuit 32 comprises an AND gate 702 and m+1 bistable circuits SR1 to SRm+1.

The AND gate 702 outputs a signal that is the logical product of the scanning line driving circuit start signal (start signal) GSP and the partial display selection signal PB. The scanning line driving circuit start signal GSP is outputted from the display control circuit 36, and indicates the timing for starting the process at every frame period, which is the cycle with which the scanning lines are driven. The partial display selection signal PB is also outputted from the display control circuit 36. The partial display selection signal PB is held a High level while full screen display is performed, and is held at Low level while partial display is performed.

The bistable circuits 701 receive the eight input signals CK, GSP, QI, GLI1, SIGQI, CLR, STMRKB and GLI2, and output the three output signals QO, GLO, and SIGQO.

The shift clock GCK1 outputted from the display control circuit 36 is inputted as the input signal CK into the bistable circuits SR1, SR5, SR9, SR13 . . . (SR4k−3). The shift clock GCK2 outputted from the display control circuit 36 is inputted as the input signal CK into the bistable circuits SR2, SR6, SRIO, SR14 . . . (SR4k−2). The shift clock GCK3 outputted from the display control circuit 36 is inputted as the input signal CK into the bistable circuits SR3, SR7, SR11, SR15 . . . (SR4k−1). And the shift clock GCK4 outputted from the display control circuit 36 is inputted as the input signal CK into the bistable circuits SR4, SR8, SR12, SR16 . . . (SR4k).

The input signal GSP of the bistable circuits SR1 to SRm+1 is the scanning line driving circuit start signal GSP outputted from the display control circuit 36, which indicates the timing for starting the process at every frame period (vertical scanning period), which is the cycle with which the scanning lines are driven. The input signal QI of the bistable circuit SR1 is the output signal of the AND gate 702. The input signal QI of each of the bistable circuits SR2 to SRm+1 is the output signal QO of the bistable circuit arranged in the respectively preceding stage. The input signal GLI1 of the bistable circuit SR1 is the output signal of the AND gate 702. The input signal GLI1 of each of the bistable circuits SR2 to SRm+1 is the output signal GLO of the bistable circuit arranged in the respectively preceding stage.

The input signal SIGQI of the bistable circuit SR1 is the initialization signal ALLCLR outputted from the display control circuit 36. The initialization signal ALLCLR is a signal for resetting all bistable circuits. The input signal (the prior-stage state signal) SIGQ1 of each of the bistable circuits SR2 to SRm+1 is the output signal SIGQO of the bistable circuit arranged in the respectively preceding stage.

The input signal (the second-subsequent output signal) GLI2 of each of the bistable circuits SR1 to SRm−1 is the output signal GLO of the bistable circuit arranged in the second subsequent stage of (i.e. the second stage after) that bistable circuit. The input signal GLI2 of the bistable circuit SRm is the output signal GLO of the bistable circuit SRm+1.

And also the input signal GLI2 of the bistable circuit SRm+1 is the output signal GLO of the bistable circuit SRm+1.

The input signal CLR of the bistable circuits SR1 to SRm+1 is the final-stage reset signal ENDCLR that is outputted from the display control circuit 36. The final-stage reset signal ENDCLR is a signal for resetting all bistable circuits other than the bistable circuit corresponding to the start position of the display region. The input signal STMRKB of the bistable circuits SR1 to SRm+1 is a start mark signal (start position setting signal) STMRKB that is outputted from the display control circuit 36. The start mark signal STMRKB is a signal for setting the bistable circuit corresponding to the start position of the display region.

The output signal QO of each of the bistable circuits SR1 to SRm serves as the input signal QI for the bistable circuit arranged in the respectively following stage. The output signal SIGQO of each of the bistable circuit SR1 to SRm serves as the input signal SIGQI of the bistable circuit arranged in the respectively following stage.

The output signal GLO of each of the bistable circuits SR1 to SRm serves as the input signal GLI1 of the bistable circuit arranged in the respectively following stage, as the input signal GLI2 of the bistable circuit arranged respectively two stages back, and as the selection signal of the respective scanning lines GL1 to GLm. The output signal GLO of the bistable circuit SRm+1 serves as the input signal GLI2 of the bistable circuit SRm−1 and the selection signal of the scanning line GLm+1.

4. Shift Register

Figure 6:
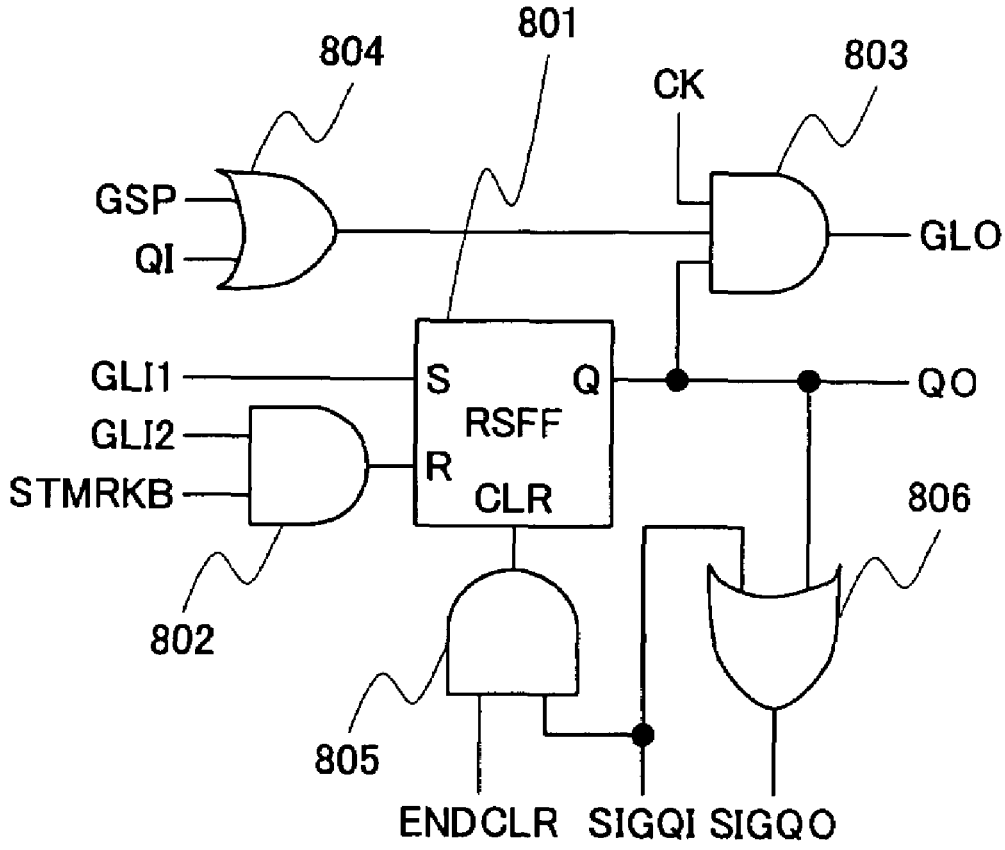
FIG. 6 is a circuit diagram showing the configuration of the bistable circuits SR1 to SRm+1 according to this embodiment.

FIG. 6 is a circuit diagram showing the configuration of the bistable circuit 701 according to the present embodiment. This bistable circuit comprises an RS flip-flop circuit 801, three AND gates 802, 803 and 805, and two OR gates 804 and 806.

The RS flip-flop circuit 801 receives the three input signals S (GL1), R (output signal from the AND gate 802) and CLR (output signal from the AND gate 805), and outputs an output signal Q. The output signal Q of the RS flip-flop circuit 801 serves as the output signal QO of the bistable circuit 701 including this RS flip-flop circuit 801, and is also given as an input signal into the AND gate 803 and as an input signal into the OR gate 806.

The AND gate (first logic gate) 802 outputs a signal given by the logical product of the input signal GLI2 and the input signal STMRKB. The start position setting circuit is realized by the AND gate 802 provided in each bistable circuit. The signal outputted by the AND gate 802 serves as the input signal R given into the RS flip-flop circuit 801. The OR gate 804 outputs a signal given by the logical sum of the input signal GSP and the input signal QI. The signal outputted from the OR gate 804 serves as the input signal given into the AND gate 803.

The AND gate 803 outputs a signal (stage output signal) GLO given by the logical product of the input signal CK, the output signal of the OR gate 804, and the output signal Q of the RS flip-flop circuit 801. The OR gate 806 outputs a signal SIGQO given by the logical sum of the input signal SIGQI and the output signal Q of the RS flip-flop circuit 801. The AND gate (second logic gate) 805 outputs a signal given by the logical product of the input signal ENDCLR and the input signal SIGQI. The reset circuit is realized by the AND gate 805 provided in each bistable circuit. The signal outputted from the AND gate 805 serves as the input signal CLR of the RS flip-flop circuit 801.

The RS flip-flop circuit 801 functions as a storage portion for discriminating the start position of the display region for partial display. In the RS flip-flop circuit 801, when the input signal S becomes High, the output signal Q becomes High. Once the output signal Q becomes High, the output signal Q is kept at High level until the input signal R or the input signal CLR become High.

The input signal S of the RS flip-flop circuit 801 is the input signal GLI1 into the bistable circuit 701 including this RS flip-flop circuit 801. The output signal Q of the RS flip-flop circuit 801 serves as the output signal QO from the bistable circuit 701 including this RS flip-flop circuit 801. Therefore, during the period in which the input signal GLI1 of the bistable circuit 701 is held a High level, the output signal QO of this bistable circuit 701 is held at High level.

5. Full Screen Display

Figure 7:
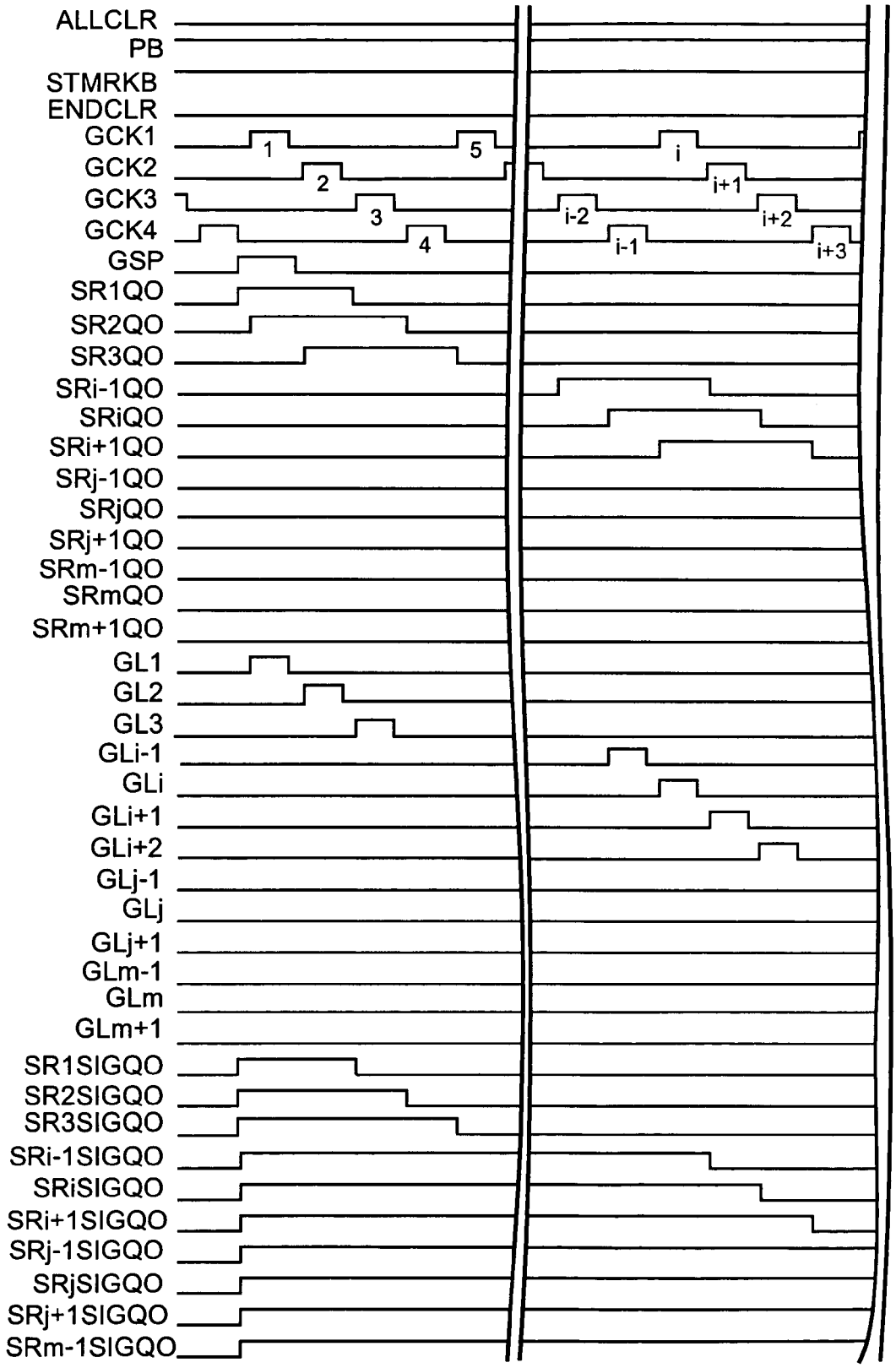
FIG. 7 is a timing chart of the scanning line driving circuit during full screen display in this embodiment.
Figure 8:
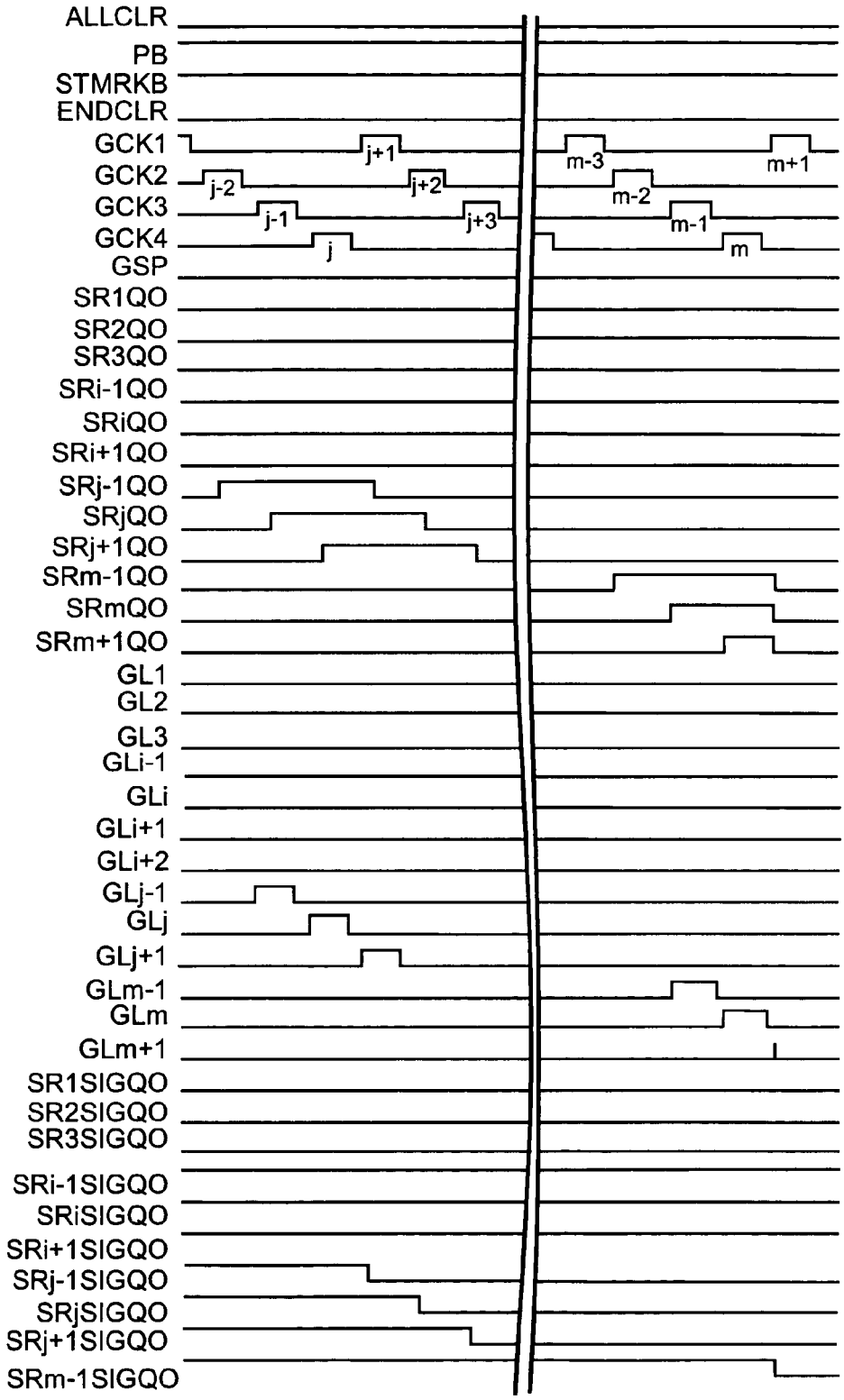
FIG. 8 is a timing chart of the scanning line driving circuit during full screen display in this embodiment.

The following is a description of the operation of the scanning line driving circuit 32 during full screen display. FIGS. 7 and 8 are timing charts of the scanning line driving circuit 32 during full screen display. The direction of the passage of time is from left to right in FIG. 7, and then from left to right in FIG. 8. The following description refers to FIGS. 4 to 8.

During a period of full screen display, the partial display selection signal PB that is outputted by the display control circuit 36 is held at High level. Here, when the scanning line driving circuit start signal GSP becomes High, the output signal of the AND gate 702 becomes High, so that also the input signal GLI1 of the bistable circuit SR1 of the first stage becomes High. Therefore, the RS flip-flop circuit 801 of the first stage is set, and the bistable circuit SR1 of the first stage is put into the set state. That is to say, as shown in FIG. 7, when the scanning line driving circuit start signal GSP becomes High, also the output signal QO (SR1QO) of the bistable circuit SR1 of the first stage becomes High. Then, when the scanning line driving circuit start signal GSP and the output signal QO of the bistable circuit SR1 of the first stage (the output signal Q of the RS flip-flop circuit 801 of the first stage) are High, the AND gate 803 outputs a signal GLO whose logic level is given by the input signal CK (shift clock GCK1). Thus, as shown in FIG. 7, when the shift clock GCK1 becomes High, the output signal GLO of the bistable circuit SR1, that is, GL1 becomes High.

Let us next consider the bistable circuit SR2 of the second stage. The input signal GLI1 of the bistable circuit SR2 is the output signal GLO (GL1) of the bistable circuit SR1. When this input signal GLI1 becomes High, the output signal QO (SR2QO) of the bistable circuit SR2 becomes High. For this reason, when the output signal GL1 of the bistable circuit SR1 becomes High, the output signal QO (SR2QO) of the bistable circuit SR2 becomes High, as shown in FIG. 7. Moreover, when the output signal QO (SR1QO) of the bistable circuit SR1 and the output signal QO of the bistable circuit SR2 (the output signal Q of the RS flip-flop circuit 801 of the second stage) are High, the AND gate 803 of the bistable circuit SR2 outputs a signal GLO whose logic level is given by the input signal CK (shift clock GCK2). Thus, as shown in FIG. 7, when the shift clock GCK2 becomes High, the output signal GLO of the bistable circuit SR2, that is, GL2 becomes High.

An operation similar to that of the bistable circuit SR2 of the second stage is also performed by each of the bistable circuits SR3 to SRm of the third to m-th stage. Therefore, the signals GL3 to GLm are sequentially set to High, as shown in FIGS. 7 and 8. By setting GL1 to GLm sequentially to High, as described above, full screen display is performed.

It should be noted that the bistable circuit SRm+1 of the (m+1)-th stage is for resetting the bistable circuit of the m-th stage, and is not provided in order to obtain GLm+1.

Next, let us consider the bistable circuit SR3 of the third stage. The output signal GLO of the bistable circuit SR3 serves as the input signal GLI2 of the bistable circuit SR1. When the input signal GLI2 of the bistable circuit SR1 and the input signal STMRKB of the bistable circuit SR1 are both High, the RS flip-flop circuit 801 of the first stage is reset, which means that the bistable circuit SR1 is reset. During the period of full screen display, the start mark signal STMRKB is kept High, so that as shown in FIG. 7, when the output signal GLO (GL3) of the bistable circuit SR3 becomes High, the output signal QO (SR1QO) of the bistable circuit SR1 becomes Low (the bistable circuit SR1 is reset).

As mentioned above, the input signal GLI2 of each of the bistable circuits SR1 to SRm−1 is the output signal GLO of the bistable circuit that is arranged respectively two stages after those bistable circuits, and the input signal GLI2 of the bistable circuit SRm is the output signal GLO of the bistable circuit SRm+1. For this reason, as shown in FIGS. 7 and 8, also the bistable circuits SR2 to SRm of the second to m-th stage are sequentially reset. Thus, at the time when all scanning lines have been driven, all bistable circuits SR1 to SRm+1 are in a reset state.

6. Partial Display

The following is an explanation of the operation of the scanning line driving circuit 32 during partial driving. In this embodiment, first, only the bistable circuit corresponding to the start position of the display region is put into the set state. Then, partial display is carried out by driving the scanning lines sequentially with the bistable circuits from that set bistable circuit to the bistable circuit corresponding to the end position of the display region. The display device 300 comprises m scanning lines, and in the following description, the scanning lines connected to the bistable circuits SRi to SRj from the i-th to the j-th stage (with $1 \leqq i < j \leqq m$) are taken to be the scanning lines corresponding to the display portion.

6.1 Setting of Bistable Circuits for Partial Display

Figure 9:
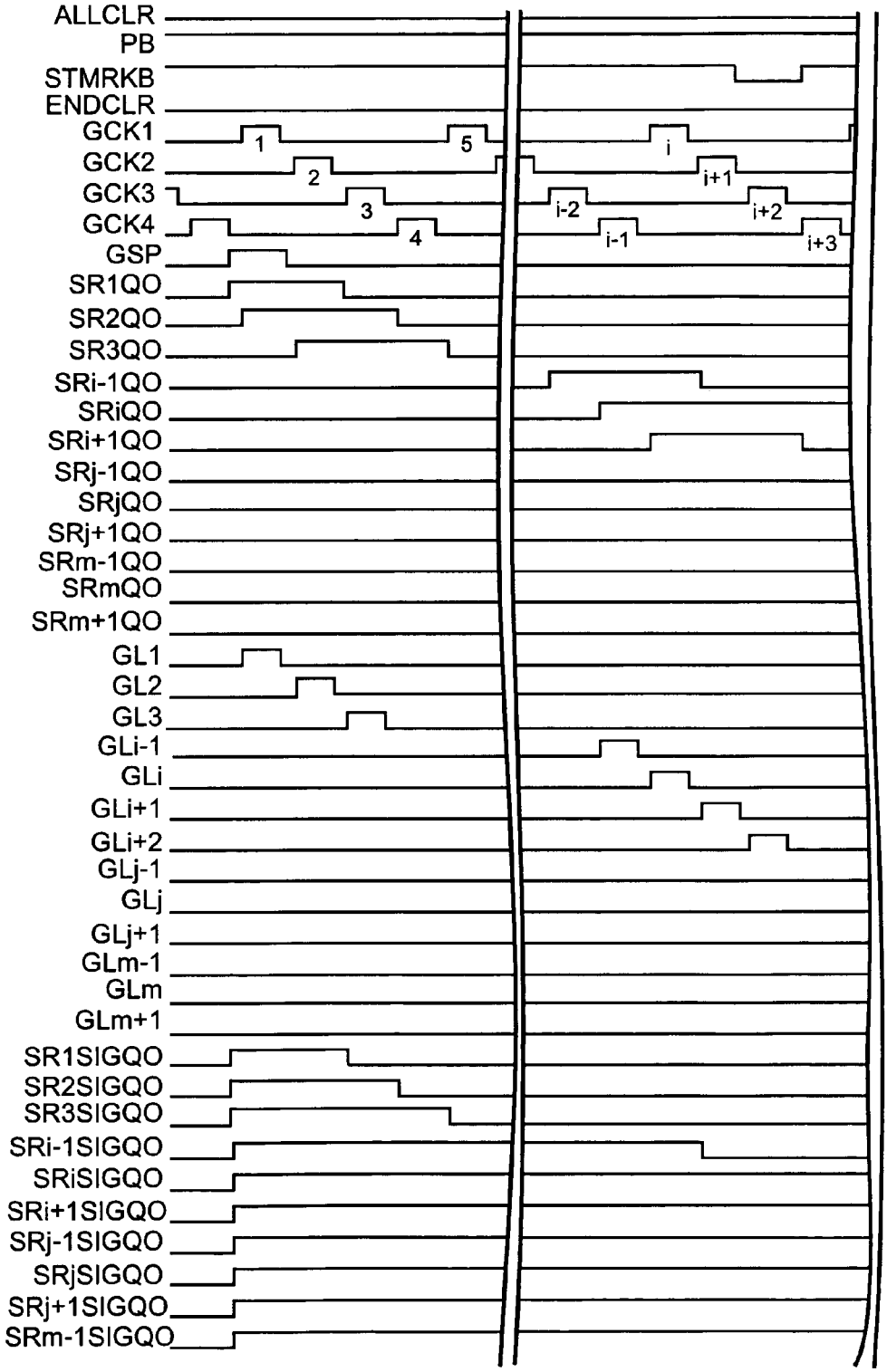
FIG. 9 is a timing chart during the setting of the bistable circuits for partial display in this embodiment.
Figure 10:
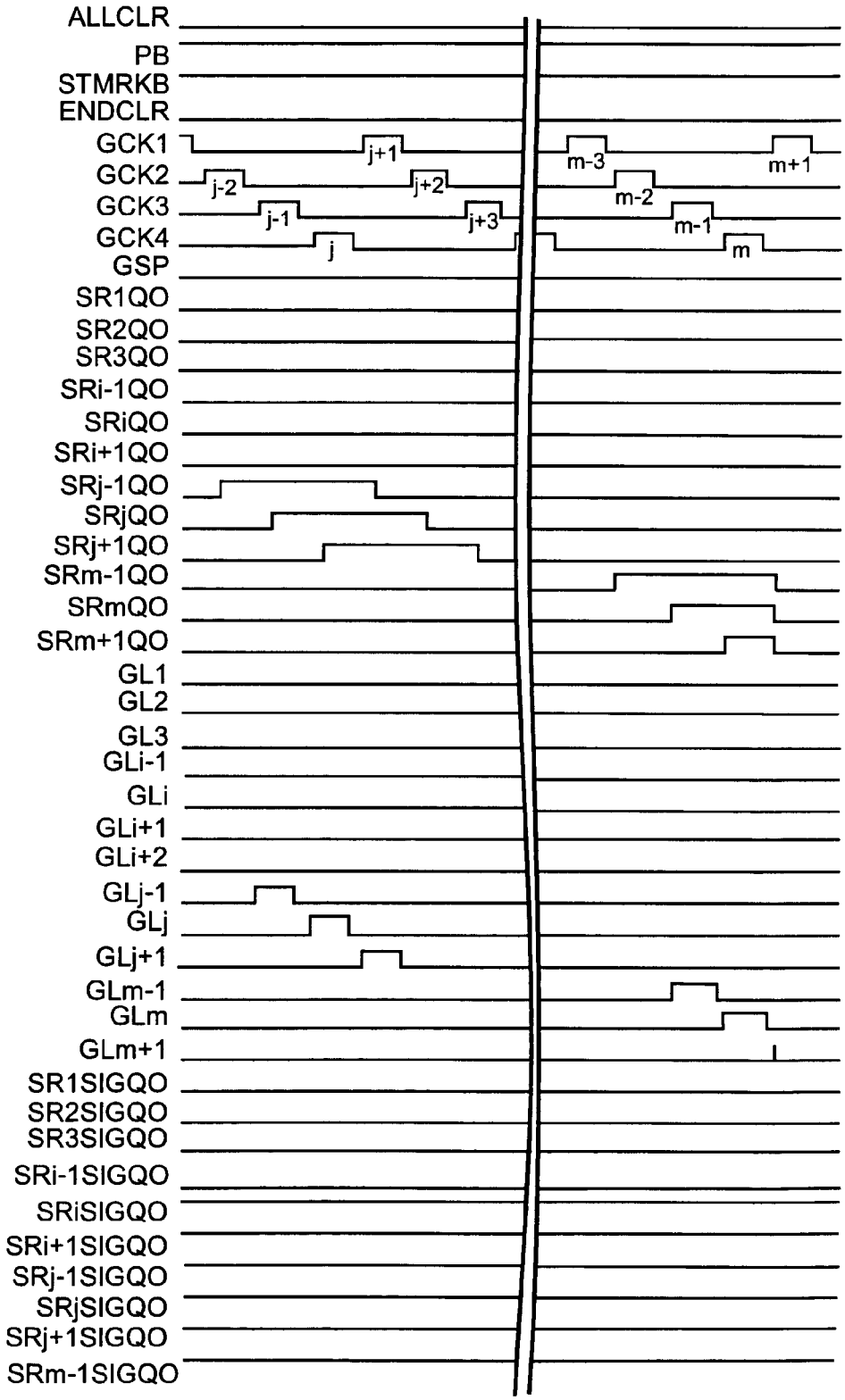
FIG. 10 is a timing chart during the setting of the bistable circuits for partial display in this embodiment.

FIGS. 9 and 10 are timing charts while setting the bistable circuits for partial display. The direction of the passage of time is from left to right in FIG. 9, and then from left to right in FIG. 10. Referring to FIGS. 4A, 4B, 5A, 5B, 6, 9 and 10, the following is an explanation of the settings of the bistable circuits for partial display.

As mentioned before, when the input signal GLI2 and the input signal STMRKB of the bistable circuit 701 become High, then the bistable circuit 701 is reset. The input signal GLI2 of the bistable circuit 701 is the output signal GLO of the bistable circuit 701 that is arranged two stages after that bistable circuit 701. Here, in order not to reset only the bistable circuit SR1 of the i-th stage corresponding to the start position of the display region, the start mark signal STMRKB is kept Low during the period in which GLi+2 is High. That is to say, the start mark signal STMRKB is kept Low during the period in which the pulse marked "i+2" of the shift clock GCK3 in FIG. 9 is kept High. Thus, at the time when all scanning lines have been driven, only the RS flip-flop circuit 801 of the i-th stage is in the set state, which means that only the bistable circuit SR1 of the i-th stage is in the set state.

Moreover, when the bistable circuit SRi of the i-th stage is set, the output signal SIGQO (SRiSIGQO) of the bistable circuit SR1 becomes High. The output signal SIGQO of the bistable circuit serves as the input signal SIGQI of the bistable circuit arranged in the next stage. When the input signal SIGQI is High, the output signal SIGQO that is outputted by the OR gate 806 is High. Therefore, as shown in FIGS. 9 and 10, at the time when all scanning lines have been driven, the output signal SIGQO of the bistable circuits from the i-th stage onward becomes High.

It should be noted that the above-noted start mark signal STMRKB is generated by the start position setting signal generating circuit 3 included in the display control circuit 36, based on the display instruction signal and the start position instruction signal that are sent from the CPU 400 of an information appliance or the like arranged outside the display device 300. The display instruction signal indicates whether full screen display or partial display is to be performed. The start position instruction signal indicates the start position of the display region for partial display.

6.2 Execution of Partial Display

Figure 11:
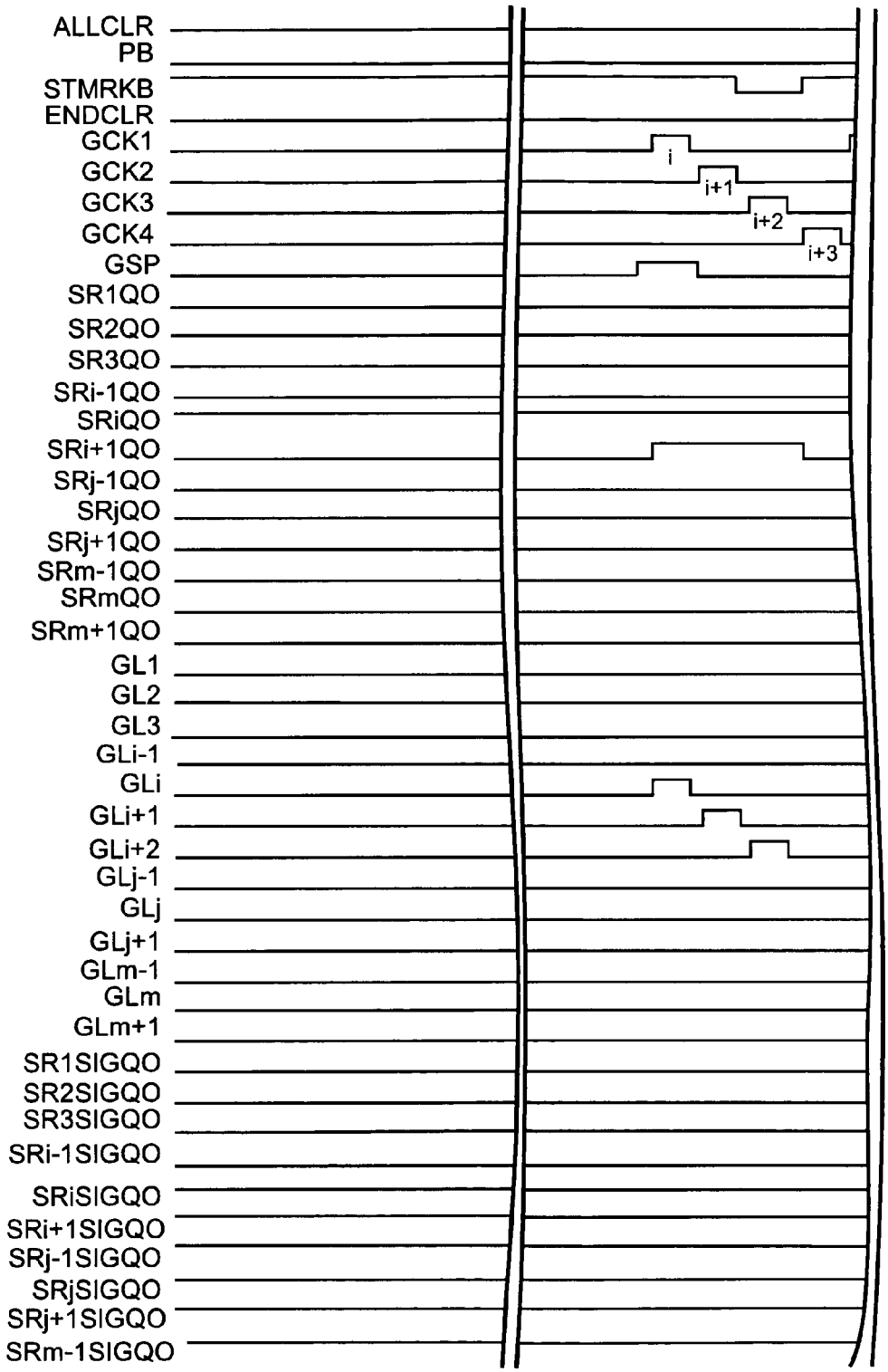
FIG. 11 is a timing chart of the scanning line driving circuit during partial display in this embodiment.
Figure 12:
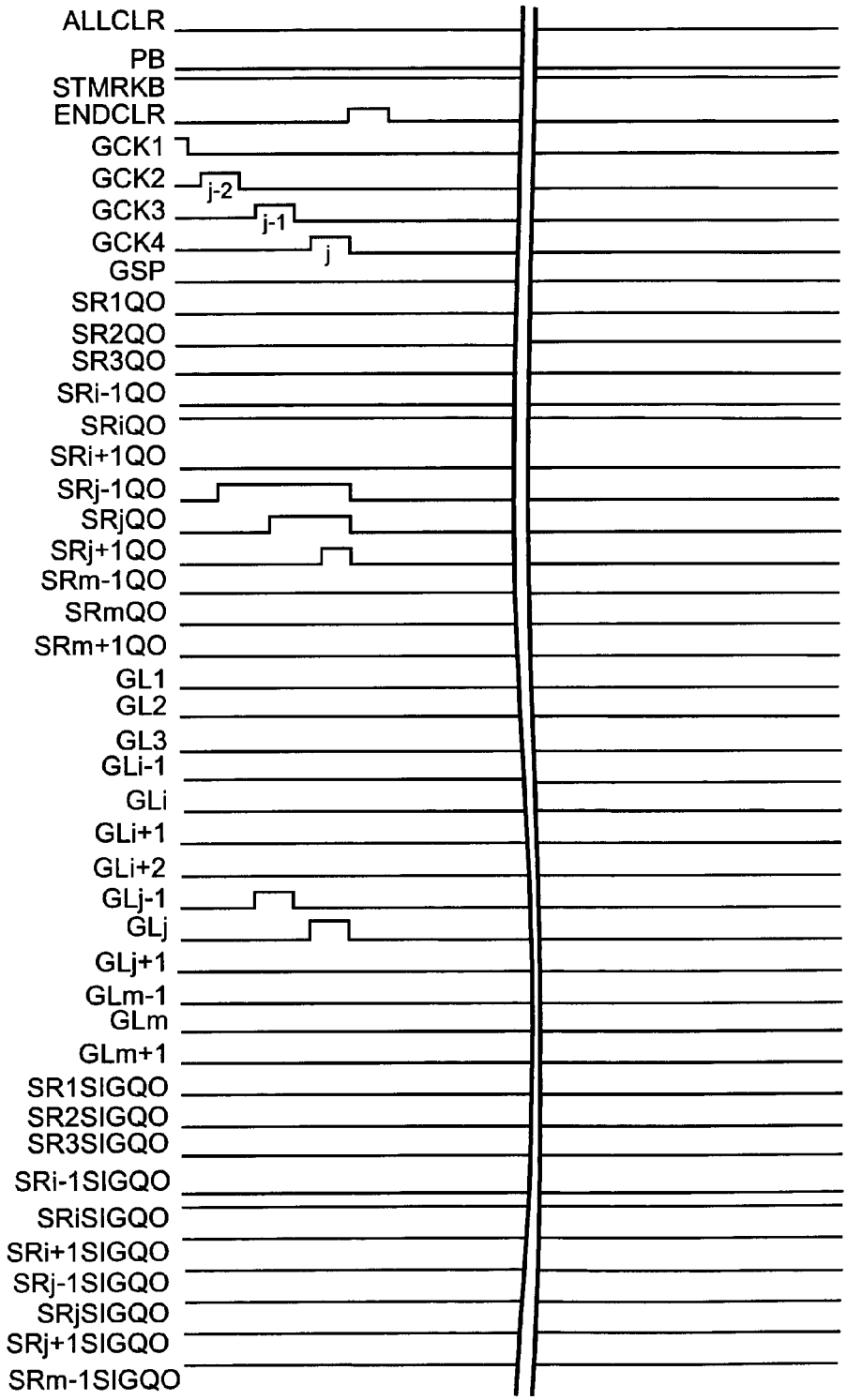
FIG. 12 is a timing chart of the scanning line driving circuit during partial display in this embodiment.

When the bistable circuit 701 corresponding to the start position of the display region has been set as described above, the partial display selection signal PB is set to Low. Then, partial display is started by setting the scanning line driving circuit start signal GSP to High. FIGS. 11 and 12 are timing charts for the scanning line driving circuit during partial display. The direction of the passage of time is from left to right in FIG. 11, and then from left to right in FIG. 12. The following description refers to FIGS. 4A, 4B, 5A, 5B, 6, 11 and 12. It should be noted that the partial display selection signal PB is kept Low until the switch is made from partial display to full screen display.

Since the partial display selection signal PB is Low, the output signal that is outputted from the AND gate 702 is Low. Therefore, the input signal GLI1 of the bistable circuit SR1 of the first stage is Low, and the bistable circuit SR1 is not set. Thus, the output signal GLO (GL1) that is outputted from the AND gate 803 of the bistable circuit SR1 is Low. The output signal GLO that is outputted from the bistable circuit SR1 of the first stage serves as the input signal GLI1 of the bistable circuit SR2 of the second stage, so that also the bistable circuit SR2 of the second stage is not set. Thus, also the output signal GLO (GL2) that is outputted from the AND gate 803 of the bistable circuit SR2 is Low. Similarly, also the bistable circuits SR3 to SRi−1 of the third to (i−1)-th stage are not reset, so that GL3 to GLi−1 are kept Low.

Next, let us consider the bistable circuit SRi of the i-th stage. As mentioned before, the RS flip-flop circuit 801 of the i-th stage is set in order to perform partial display. That is to say, the output signal Q of the RS flip-flop circuit 801 of the i-th stage is High. For this reason, when the scanning line driving circuit start signal GSP and the input signal CK (shift clock GCK1) become High, the output signal GLO that is outputted from the AND gate 803 becomes High. This means that GLi becomes High, and the scanning line of the i-th stage is driven.

Furthermore, GLi serves as the input signal GLI1 of the bistable circuit SRi+1 of the (i+1)-th stage, so that when GLi becomes High, the bistable circuit SRi+1 of the (i+1)-th stage is set. Moreover, the output signal QO of the bistable circuit SRi serves as the input signal QI of the (i+1)-th bistable circuit SRi+1, and the output signal QO (SQiQO) of the bistable circuit SRi is High, so that the input signal QI of the bistable circuit SRi+1 of the (i+1)-th stage is High. Therefore, an output signal GLO (GLi+1) that is High is outputted from the AND gate 803 of the bistable circuit SRi+1 of the (i+1)-th stage, in synchronization with the input signal CK (shift clock GCK2). Also for the bistable circuits SRi+2 to SRj of the (i+2)-th to j-th stage, an operation that is similar to that of the bistable circuit of the (i+1)-th stage is carried out. Therefore, GLi+2 to GLj are sequentially set to High.

Here, it has been explained that the shift clock that is inputted into the bistable circuit SR1 of the i-th stage is GCK1, but the shift clock that is inputted into the bistable circuit SRi of the i-th stage may be any of the shift clocks GCK1 to GCK4. For example, in the case where the shift clock that is inputted into the bistable circuit SR1 of the i-th stage is GCK2, the scanning line driving circuit GSP is set to High while the shift clock GCK2 is High. Thus, GLi to GLj sequentially become High, as shown in FIGS. 11 and 12.

The following is a description of the resetting of the bistable circuits. As pointed out above, the input signal GLI2 of each of the bistable circuits is the output signal GLO of the bistable circuit that is arranged respectively two stages after that bistable circuit, and when the input signal GLI2 and the start mark signal STMRKB become High, the RS flip-flop circuit 801 within that bistable circuit is reset, namely that bistable circuit is reset. In this embodiment, in order not to reset the bistable circuit SRi of the i-th stage, the start mark signal STMRKB is kept Low during the period in which GLi+2 is High. On the other hand, during the period in which GLi+2 is Low, the start mark signal STMRKB is kept High, so that the bistable circuits SRi+1 to SRj−2 of the (i+1)-th to (j−2)-th stage are reset when the output signal GLO of the bistable circuit arranged respectively two stages after those bistable circuits become High.

Here, during the partial display from the i-th stage to the j-th stage, GLj+1, GLj+2 and GLj+3 are kept Low. Therefore, the input signals GLI2 of the bistable circuits SRj−1 to SRj+1 of the (j−1)-th stage to the (j+1)-th stage are kept Low. In this case, the bistable circuits SRj−1 to SRj+1 of the (j−1)-th stage to the (j+1)-th stage are not reset by the output signal from the AND gate 802. Accordingly, in the present embodiment, when GLj is turned from High to Low, the final-stage reset signal ENDCLR is set to High. The output signal SIGQO of the i-th and following stages has been High, and this output signal SIGQO serves as the input signal SIGQI of the bistable circuit arranged at the respectively following stage, so that the output signal that is outputted from the AND gate 805 in each of the bistable circuits SRj−1 to SRj+1 of the (j−1)-th stage to the (j+1)-th stage is High. Thus, the bistable circuits SRj−1 to SRj+1 of the (j−1)-th stage to the (j+1)-th stage are reset.

It should be noted that the previously mentioned final-stage reset signal ENDCLR is generated by the final-stage reset signal generating circuit 4 included in the display control circuit 36, based on the display instruction signal and the end position instruction signal that are sent from the CPU 400 of an information appliance or the like arranged outside the display device 300. The display instruction signal indicates whether full screen display or partial display is to be performed. The end position instruction signal indicates the end position of the display region for partial display.

Partial display of the i-th stage to j-th stage is performed by setting GLi to GLj sequentially to High as described above. Moreover, at the time when the scanning lines connected to the bistable circuits from the i-th stage to the j-th stage are driven, only the RS flip-flop circuit 801 of the i-th stage is in the set state, that is, only the bistable circuit SRi of the i-th stage is in the set state. Therefore, after making a switch from one frame to another frame, partial display from the i-th stage to the j-th stage is performed.

7. The Phase Number of Shift Clock

Figure 13:
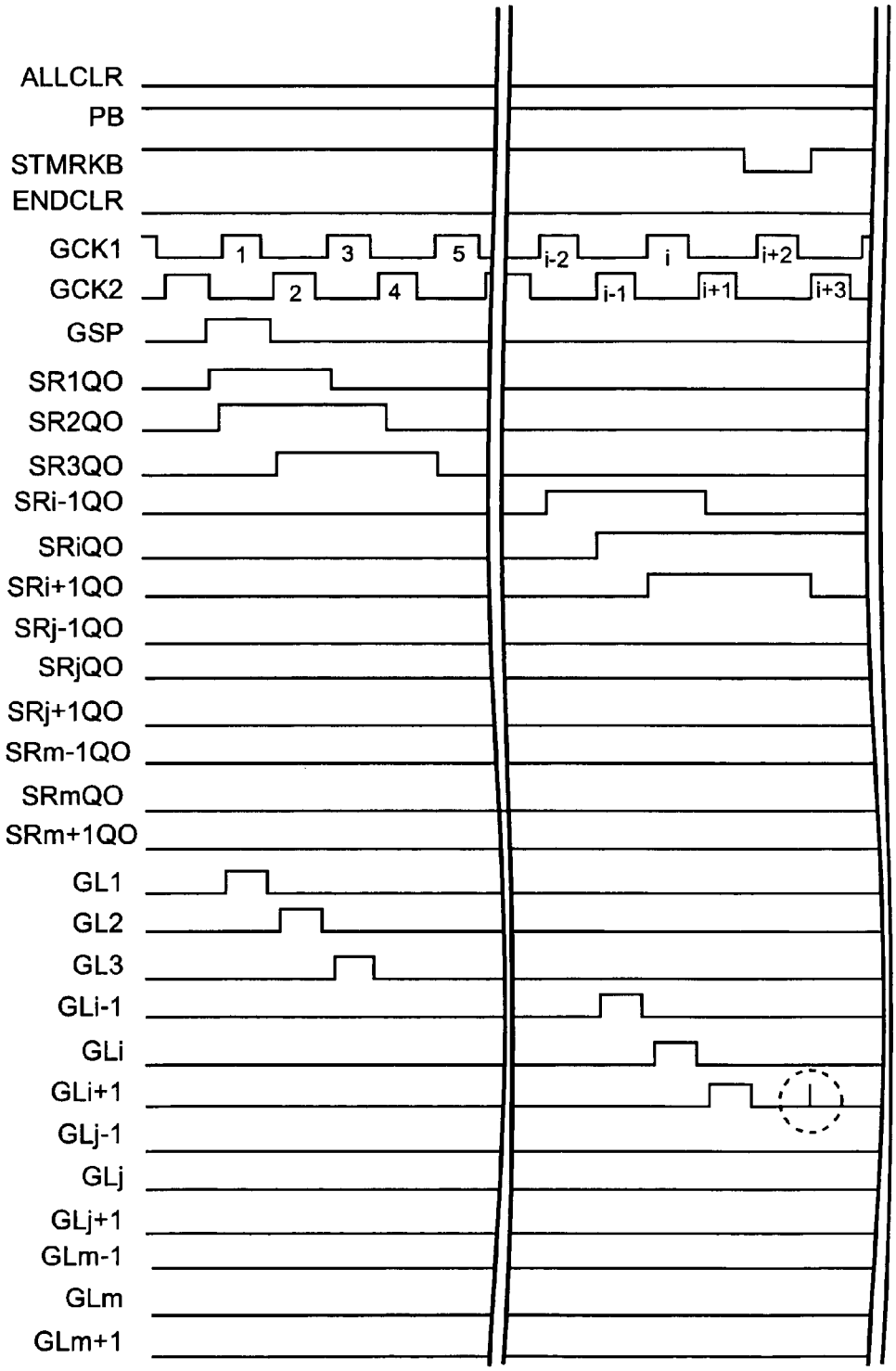
FIG. 13 is a timing chart of the scanning line driving circuit when the display device according to the present embodiment is realized with a two-phase shift clock.
Figure 14:
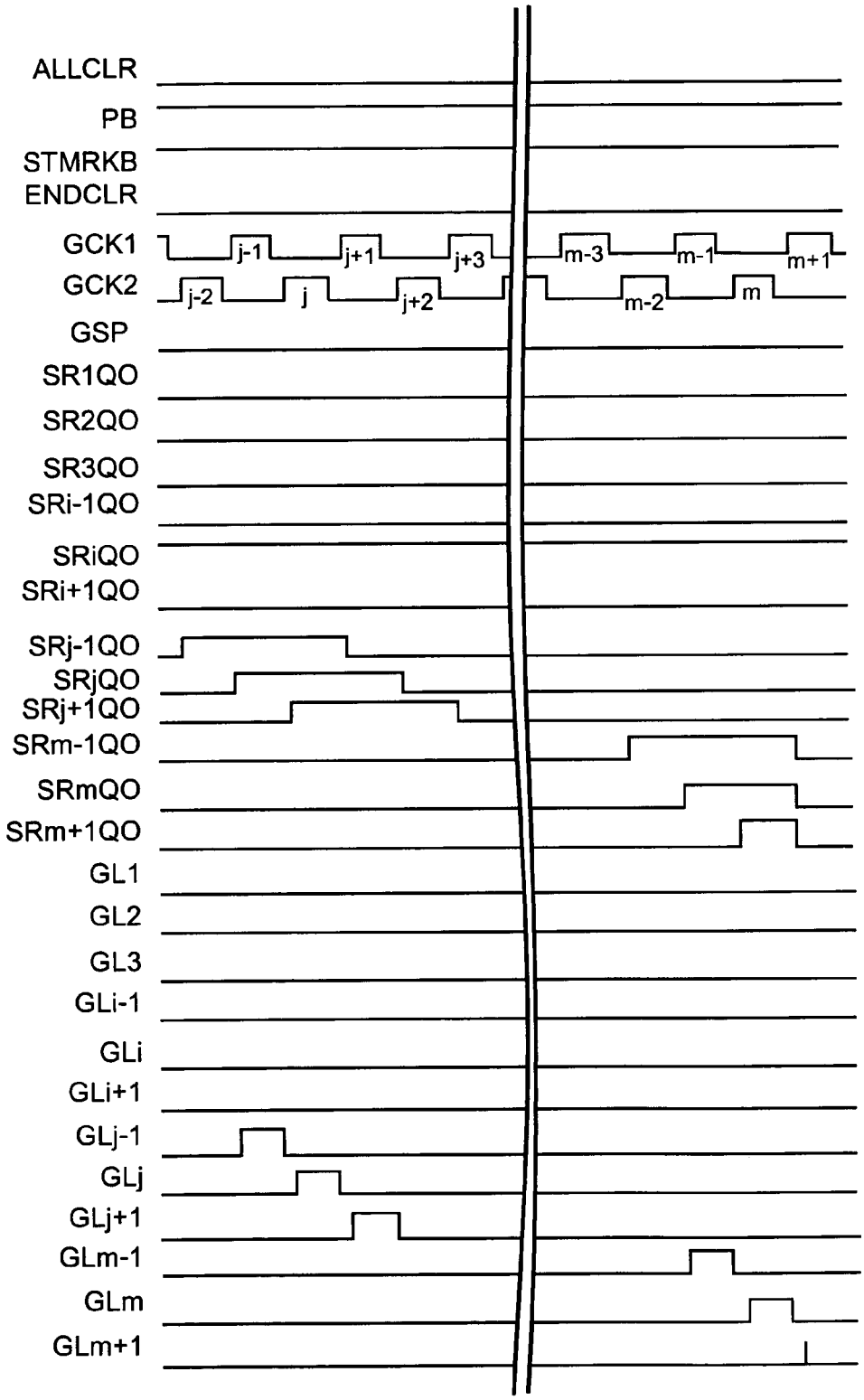
FIG. 14 is a timing chart of the scanning line driving circuit when the display device according to the present embodiment is realized with the two-phase shift clock.
Figure 15:
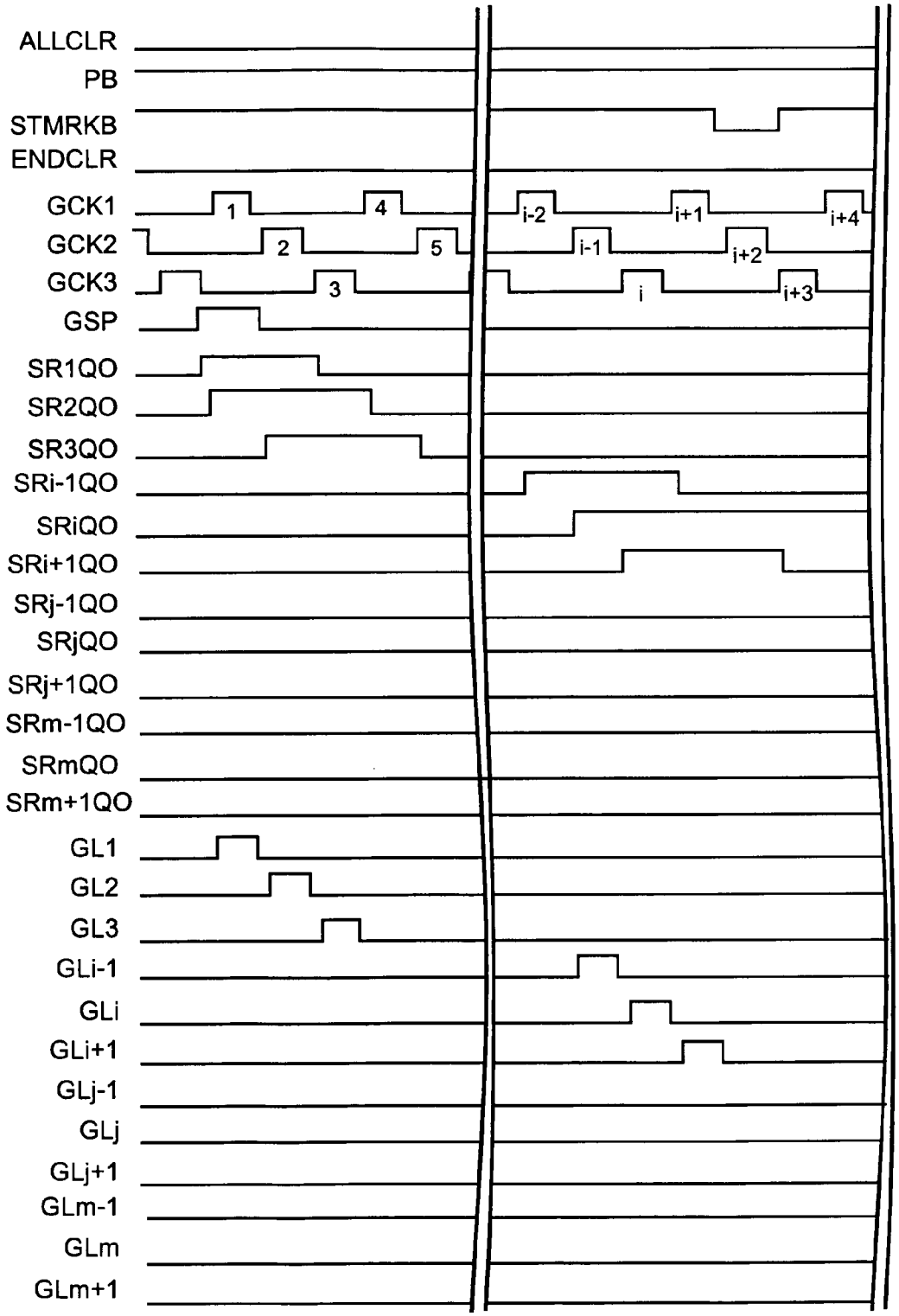
FIG. 15 is a timing chart of the scanning line driving circuit when the display device according to the present embodiment is realized with a three-phase shift clock.
Figure 16:
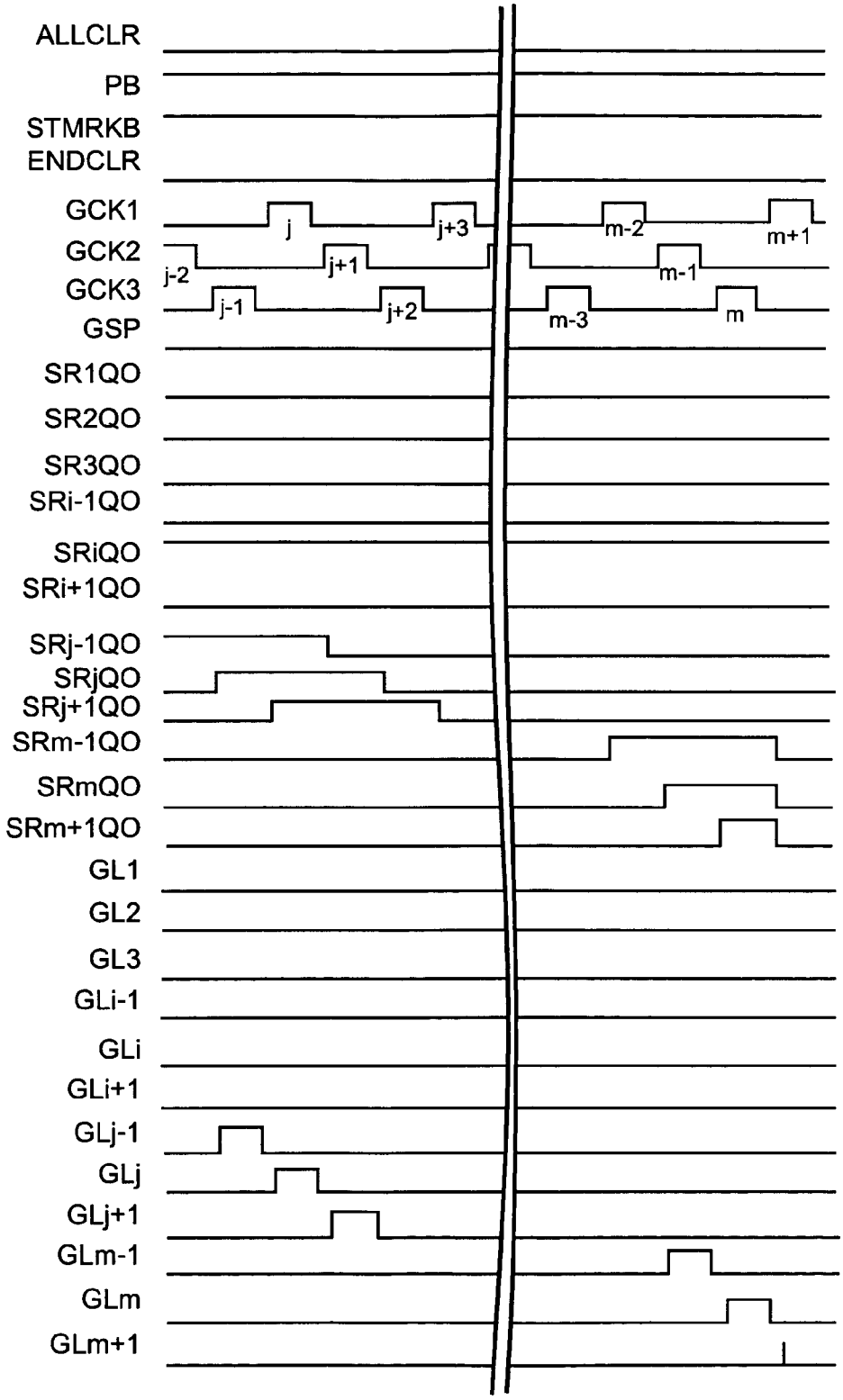
FIG. 16 is a timing chart of the scanning line driving circuit when the display device according to the present embodiment is realized with the three-phase shift clock.
Figure 17:
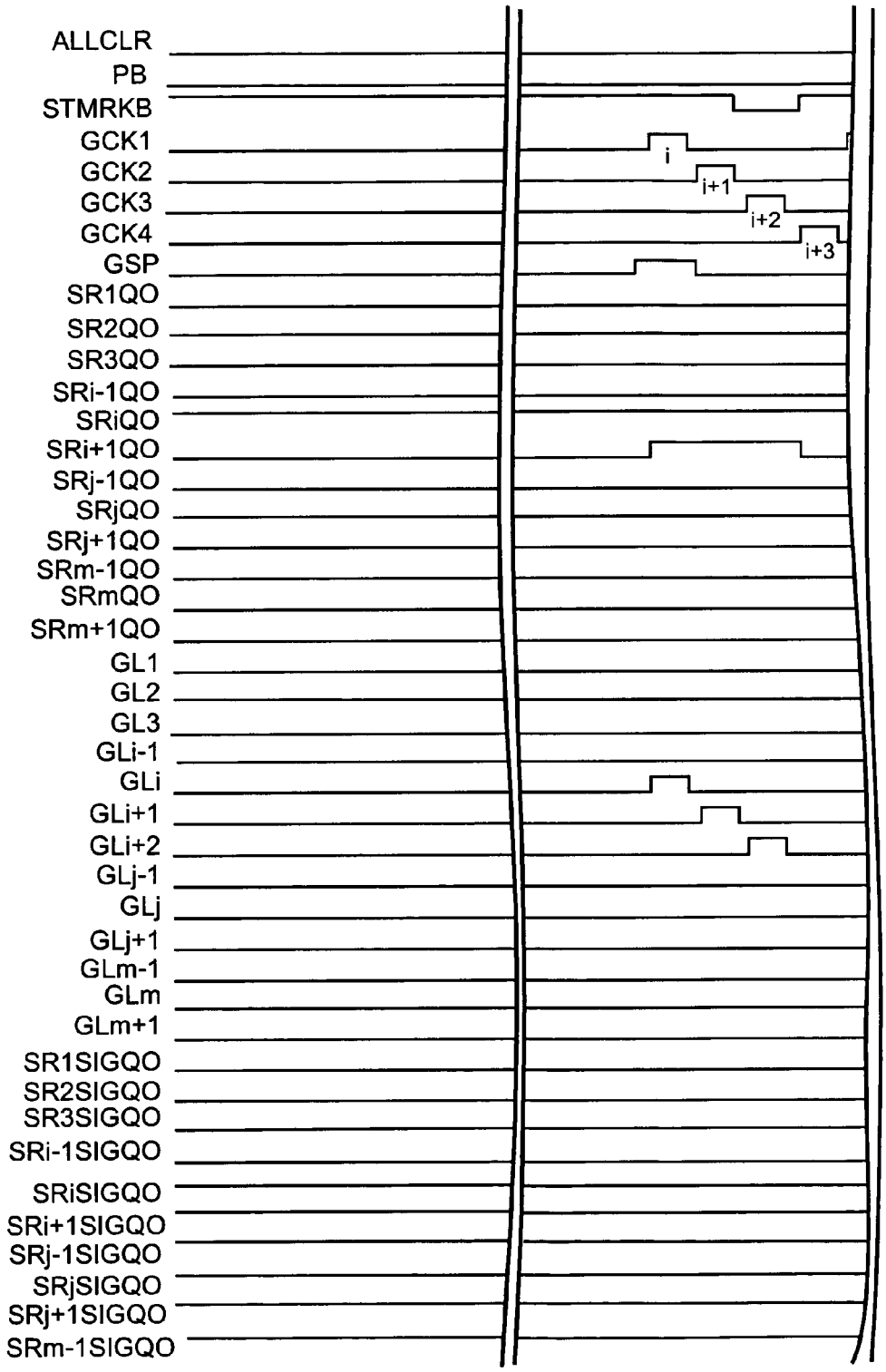
FIG. 17 is a timing chart of the scanning line driving circuit of the display device realizing partial display using a scanning line driving circuit start signal instead of the final-stage reset signal.

In the display device 300 according to the present embodiment, partial display is realized with a four-phase shift clock GCK1 to GCK4. The number of phases of the shift clock GCK is not limited to four, but it is preferable that it is three or greater. FIGS. 13 and 14 are timing charts of the scanning line driving circuit 32 for the case that the display device according to the present embodiment is realized with a two-phase shift clock. The direction of the passage of time is from left to right in FIG. 13, and then from left to right in FIG. 14. FIGS. 15 and 16 are timing charts of the scanning line driving circuit 32 for the case that the display device 300 according to the present embodiment is realized with a three-phase shift clock. The direction of the passage of time is from left to right in FIG. 15, and then from left to right in FIG. 16. Referring to FIGS. 13 to 16, the following is an explanation of why it is desirable that the phase number of the shift clock is three or greater.

The AND gate 803 in the bistable circuits outputs an output signal GLO that is High when a shift clock that is High is inputted while that bistable circuit and the bistable circuit arranged in the previous stage are in the set state. Here, in the case where the phase number of the shift clock is two, when the shift clock GCK2 marked "i+3" in FIG. 13 becomes High in order to turn GLi+3 to High, the bistable circuit SRi+1 of the (i+1)-th stage is put from the set state to the reset state. On the other hand, the bistable circuit SR1 of the i-th stage is not reset, as noted above. Therefore, when the shift clock GCK2 is set to High in order to set GLi+3 to High, a hazard occurs as shown by the dotted circuit in FIG. 13. Thus, a hazard occurs for the case that the number of phases of the shift clock is two.

On the other hand, in the case where the number of phases of the shift clock is three, after a High output signal GLO (GLi+1) is outputted from the bistable circuit SRi+1 of the (i+1)-th stage, the bistable circuit SRi+1 is reset by the time when a shift clock that is High (in FIG. 15, this is the shift clock GCK1 marked "i+4) is inputted into that bistable circuit SRi+1 subsequently. Therefore, no hazard occurs as in the case when the number of phases of the shift clock is two. Thus, it is preferable that the number of phases of the shift clock is three or greater.

8. Modification Examples 8.1. Modification Example 1

In the above embodiment, the bistable circuits SRj−1 to SRj+1 of the (j−1)-th to (j+1)-th stage are reset by the final-stage reset signal ENDCLR, but the present invention is not limited to this. It is also possible to reset the bistable circuits SRj−1 to SRj+1 of the (j−1)-th to (j+1)-th stage with the scanning line driving circuit start signal GSP instead of with the final-stage reset signal ENDCLR. FIGS. 17 to 20 are timing charts of the scanning line driving circuit 32 of the display device in which partial driving is carried out by resetting the bistable circuits SRj−1 to SRj+1 of the (j−1)-th to (j+1)-th stage with the scanning line driving circuit start signal GSP instead of with the final-stage reset signal ENDCLR. The direction of the passage of time is from left to right in FIG. 17, then from left to right in FIG. 18, then from left to right in FIG. 19, and then from left to right in FIG. 20. Referring to FIGS. 6 and 17 to 20, the following is a description of this scanning line driving circuit 32.

Figure 18:
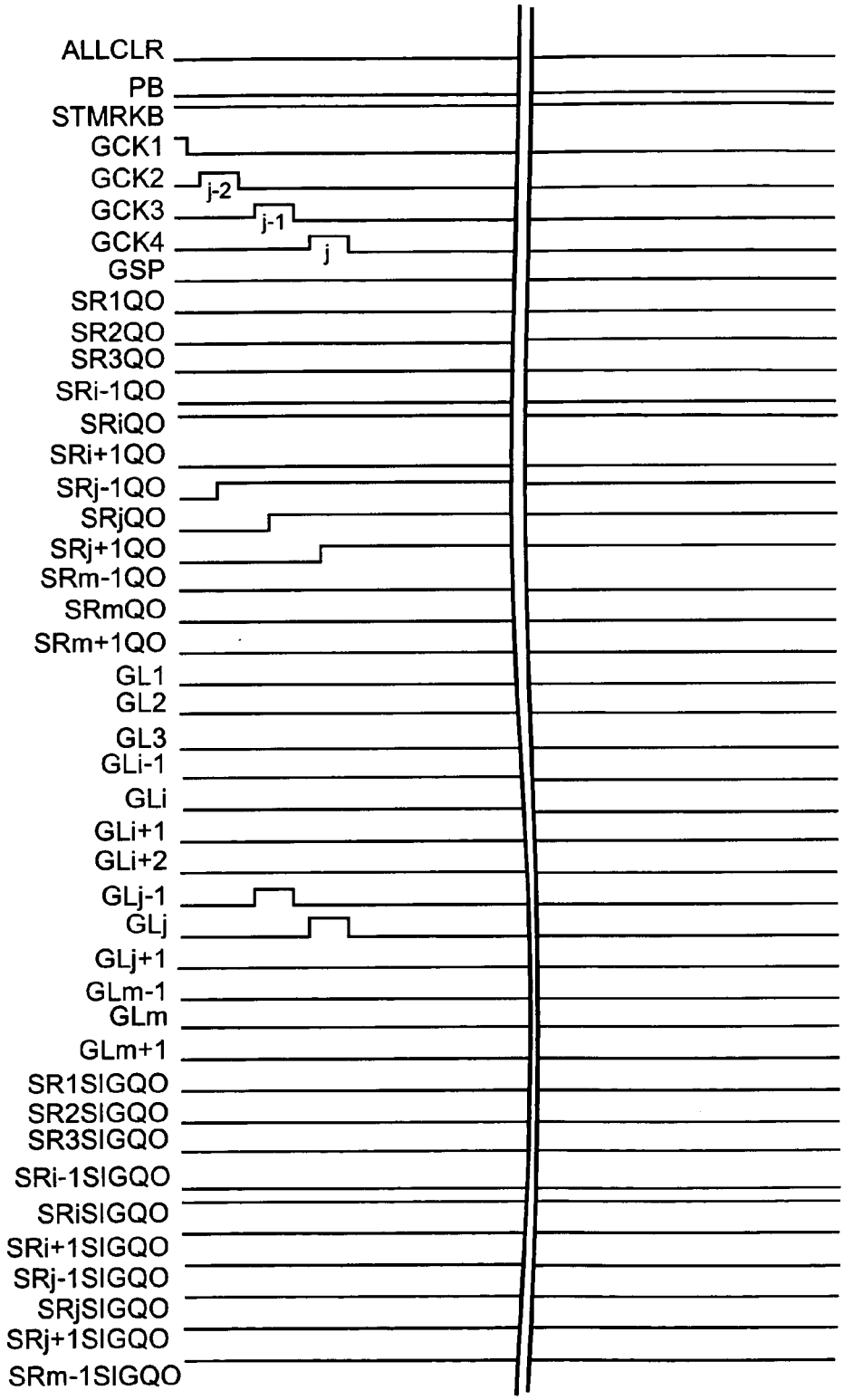
FIG. 18 is a timing chart of the scanning line driving circuit of the display device realizing partial display using the scanning line driving circuit start signal instead of the final-stage reset signal.

As shown in FIG. 18, after the output signal GLj outputted from the bistable circuit SRj of the j-th stage has been set from High to Low, the shift clocks GCK1 to GCK4 are held at Low level. Thus, the output signals GLO (GLj+1 to GLm) outputted from the bistable circuits of the (j+1)-th stage onward do not become High. Therefore, at the time when the scanning lines connected to the bistable circuits from the i-th stage to the j-th stage have been driven, the bistable circuits SRj−1 to SRj+1 from the (j−1)-th stage to the (j+1)-th stage are in the set state.

Figure 19:
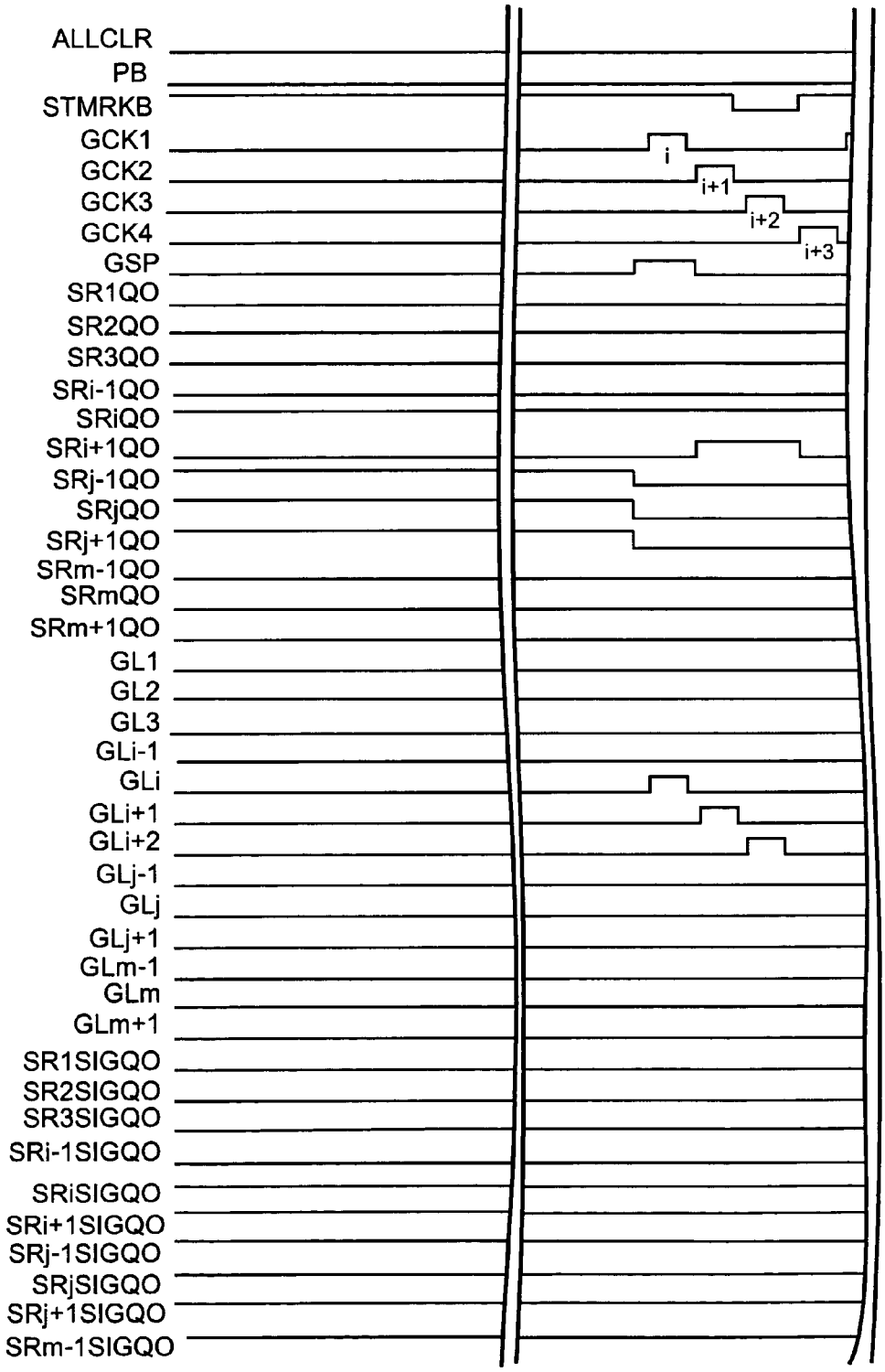
FIG. 19 is a timing chart of the scanning line driving circuit of the display device realizing partial display using the scanning line driving circuit start signal instead of the final-stage reset signal.
Figure 20:
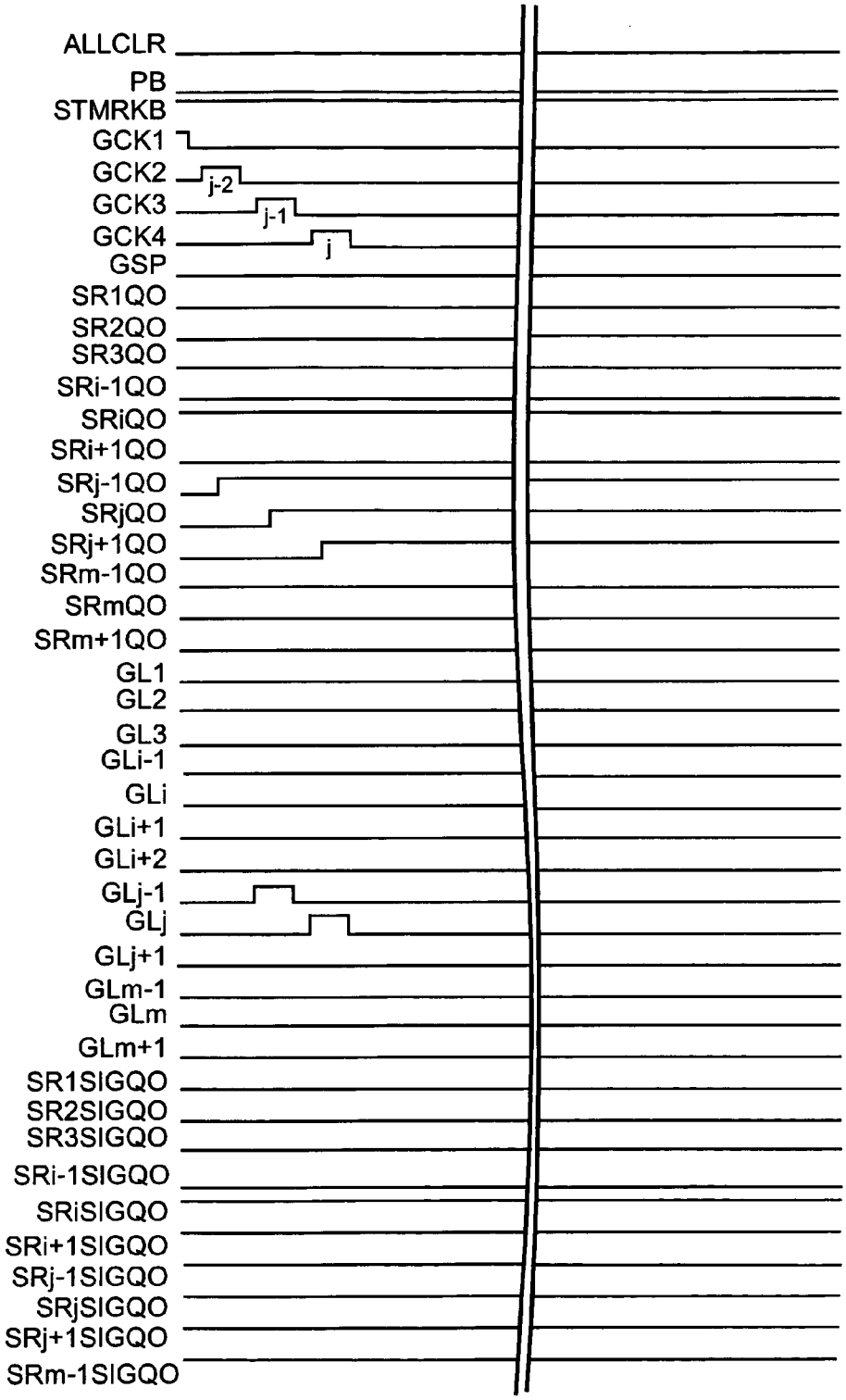
FIG. 20 is a timing chart of the scanning line driving circuit of the display device realizing partial display using the scanning line driving circuit start signal instead of the final-stage reset signal.

After the scanning lines connected to the bistable circuits from the i-th stage to the j-th stage have been driven, in the next frame period, the scanning line driving circuit start signal GSP is set to High, as shown in FIG. 19. Here, this scanning line driving circuit start signal GSP replaces the input signal ENDCLR in FIG. 6. That is to say, the scanning line driving circuit start signal GSP is inputted at the position of the input signal ENDCLR in FIG. 6. Moreover, the input signal SIGQI of the bistable circuits SRj−1 to SRj+1 of the (j−1)-th stage to the (j+1)-th stage is the output signal SIGQO of the bistable circuit arranged respectively in the stage prior to that bistable circuit. Here, the output signals SIGQO (SRiSIGQO to SRm-1SIGQO) of the bistable circuits of the i-th stage onward are at High level, so that the output signal of the AND gate 805 in the bistable circuits SRj−1 to SRj+1 of the (j−1)-th stage to the (j+1)-th stage is High. Thus, the bistable circuits SRj−1 to SRj+1 of the (j−1)-th stage to the (j+1)-th stage are reset. On the other hand, the output signal SRi-1SIGQO of the bistable circuit SRi−1 of the (i−1)-th stage is Low, so that the bistable circuit SRi of the i-th stage is not reset.

In this manner, in the present embodiment, the bistable circuits SRj−1 to SRj+1 of the (j−1)-th stage to the (j+1)-th stage are reset by the scanning line driving circuit start signal GSP instead of the final-stage reset signal ENDCLR. Thus, in each frame period in which the scanning lines are sequentially driven, only the bistable circuit corresponding to the start position of the display region is put into the set state at the time when the scanning line driving circuit start signal GSP has become High. Moreover, after the scanning line of the j-th stage has been driven, the shift clocks GCK1 to GCK4 are kept Low. Thus, the scanning lines connected to the bistable circuits of the i-th to the j-th stage are sequentially driven, and partial display is carried out.

8.2. Modification Example 2

Figure 21:
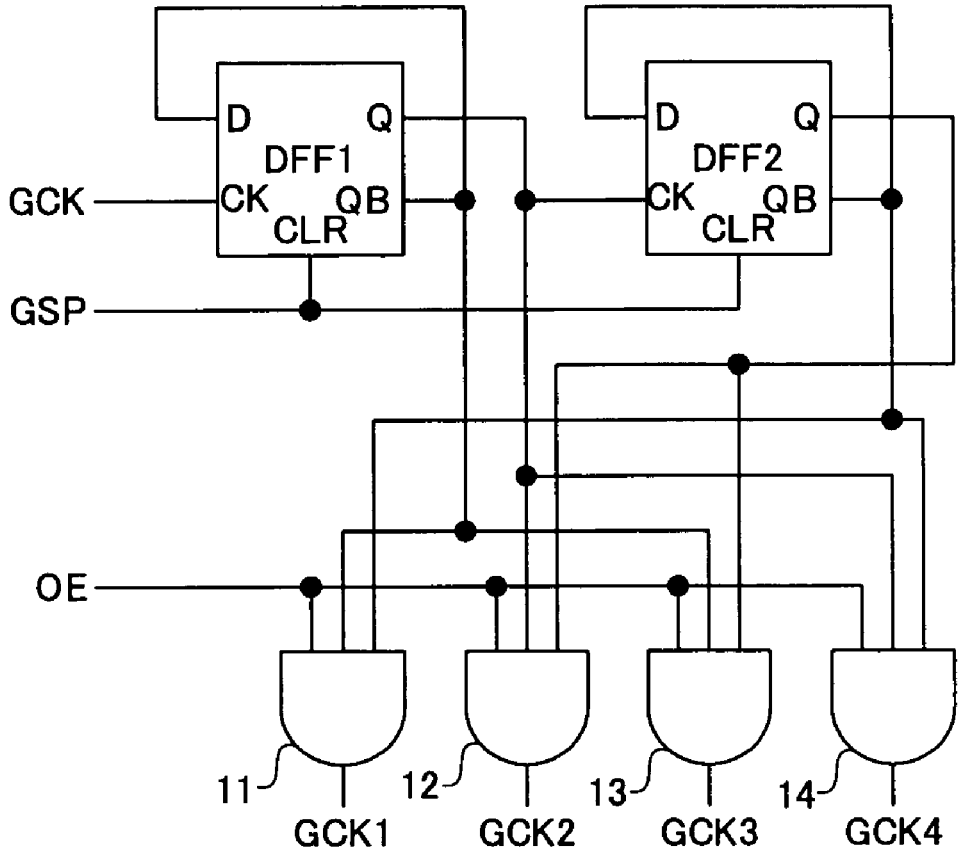
FIG. 21 is a circuit diagram of the shift clock generating circuit of the display device according to a modification example of the present embodiment.

In this modification example, the scanning line driving circuit start signal GSP is inputted into the shift clock generating circuit 5 generating the shift clocks. FIG. 21 is a circuit diagram of this shift clock generating circuit 5 of the display device 300 according to this modification example. The input signal (scanning line driving circuit start signal) GSP of this shift clock generating circuit 5 serves as the input signal CLR inputted into the D flip-flop circuits DFF1 and DDF2 comprised by this shift clock generating circuit 5. For this reason, when the input signal GSP becomes High, the D flip-flop circuits DFF1 and DFF2 are reset. At this time, the output signal QB of the D flip-flop circuits DFF1 and DFF2 becomes High. Then, while the output signals QB of the D flip-flop circuits DFF1 and DFF2 are High and also the input signal OE is High, the output signal GCK1 of the AND gate 11 is High.

Figure 22:
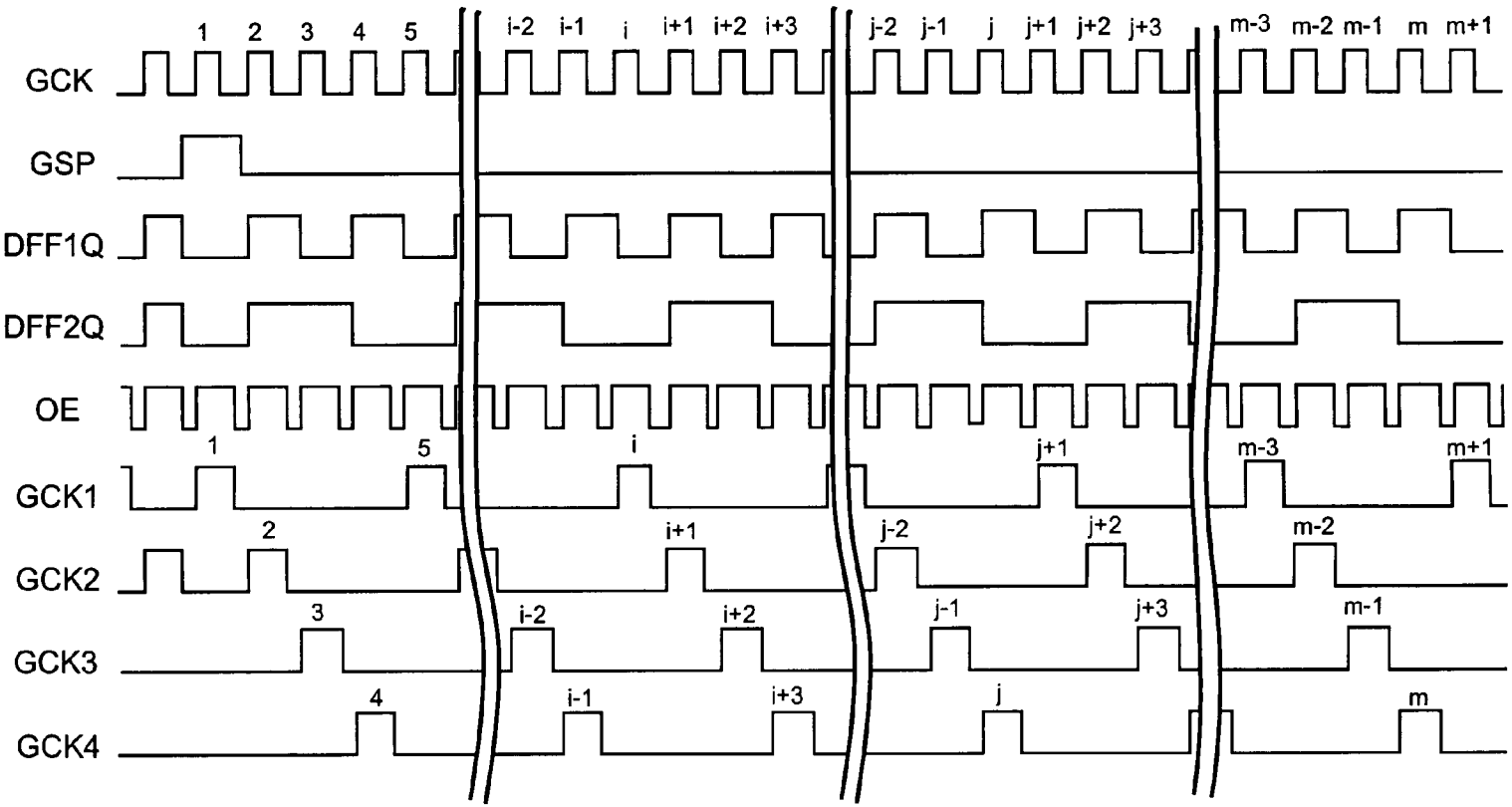
FIG. 22 is a timing chart of the scanning line driving circuit according to the modification example of the present embodiment.
Figure 23A:
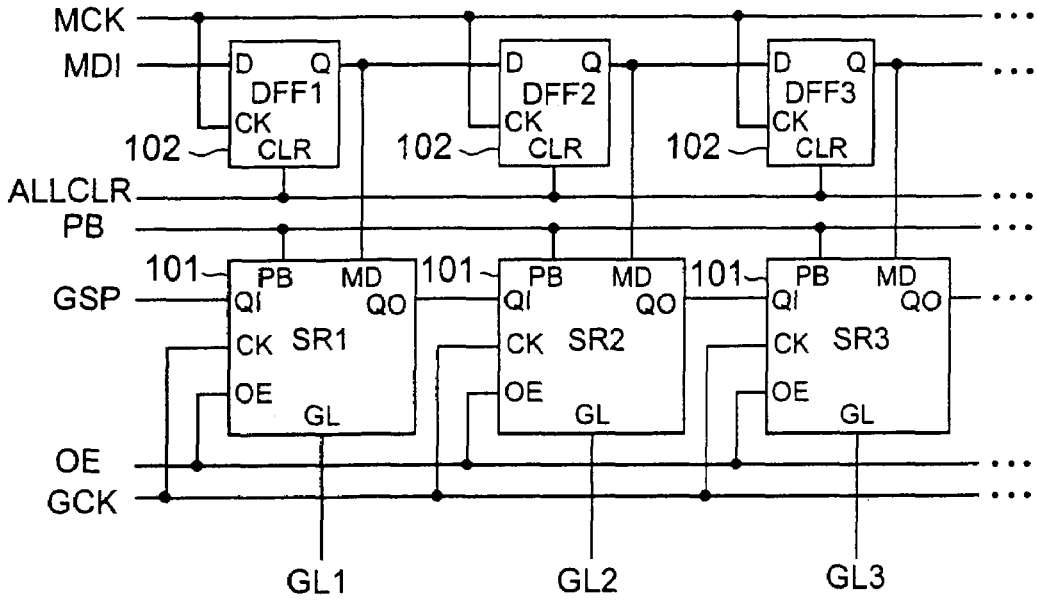
Fig.23A (Prior Art)
FIGS. 23A and 23B are circuit diagrams showing the configuration of a scanning line driving circuit (1 to (i+1)-th stage) of a conventional display device.
Figure 23B:
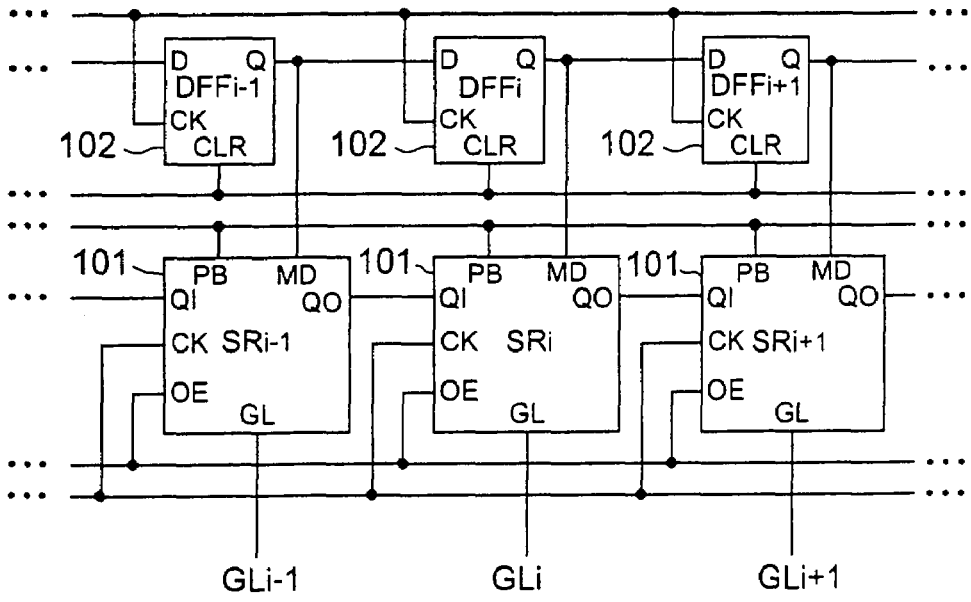
Fig.23B (Prior Art)
Figure 24A:
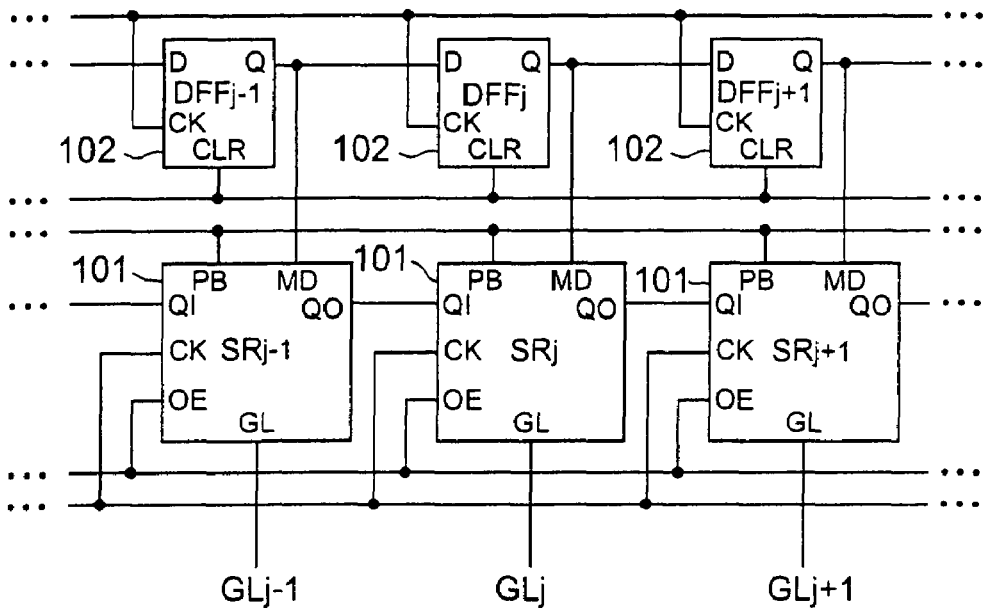
Fig.24A (Prior Art)
FIGS. 24A and 24B are circuit diagrams showing the configuration of a scanning line driving circuit ((j−1)-th to m-th stage) of the conventional display device.
Figure 24B:
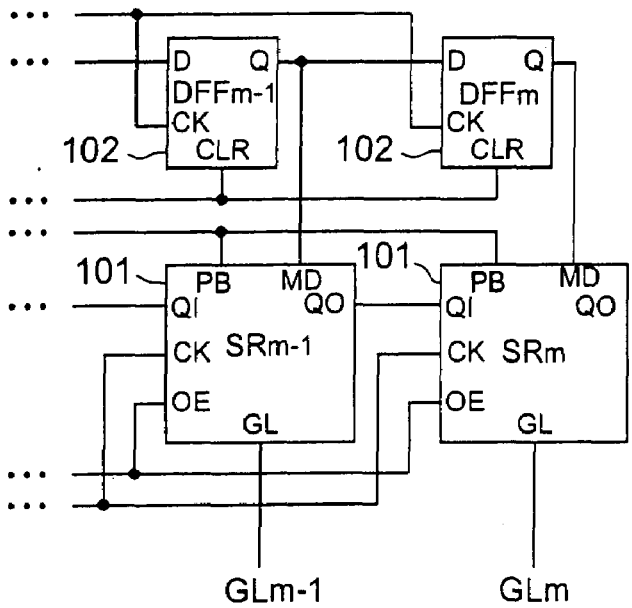
Fig.24B (Prior Art)
Figure 25:
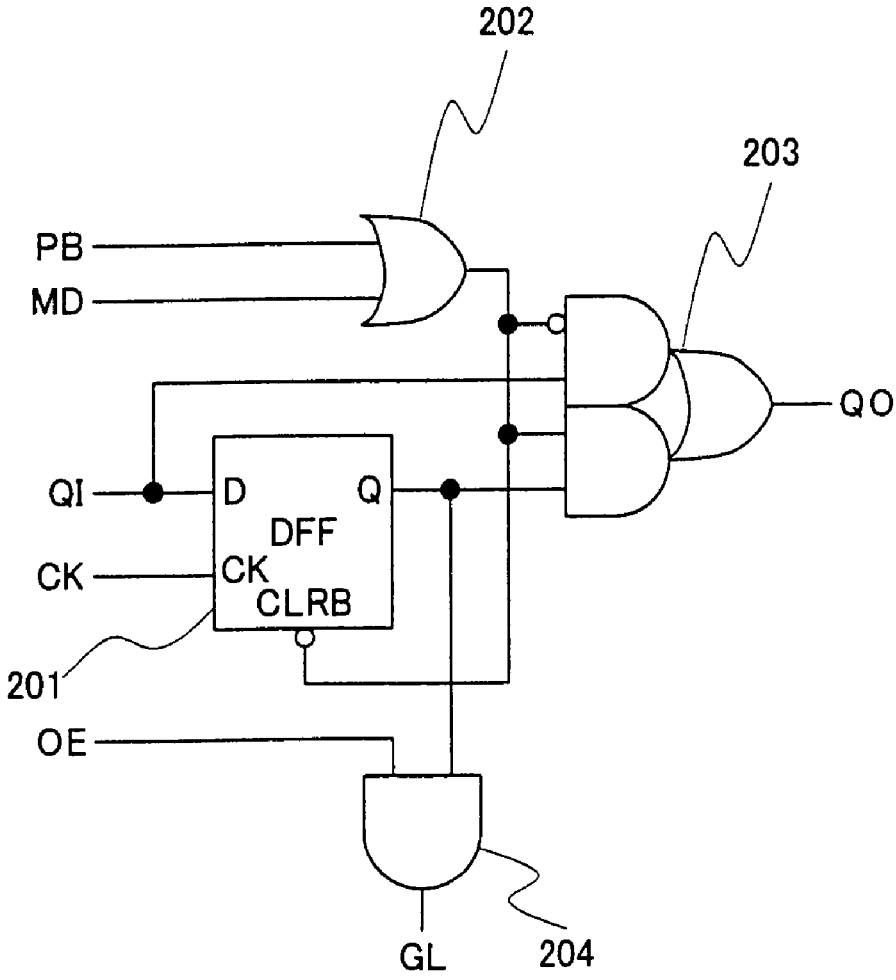
Fig.25 (Prior Art)
FIG. 25 is a circuit diagram showing the configuration of a bistable circuit of the conventional scanning line driving circuit.
Figure 26:
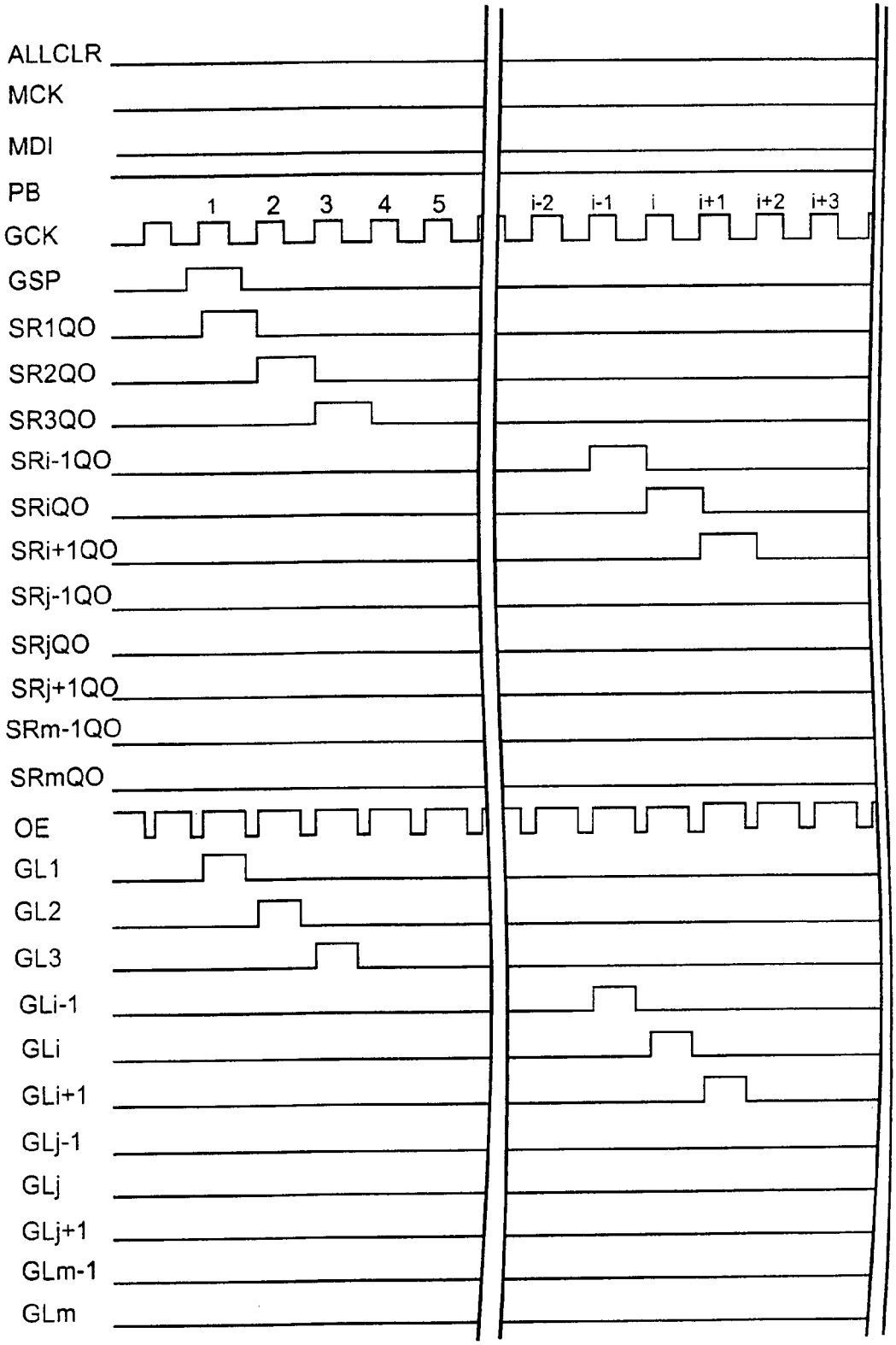
Fig.26 (Prior Art)
FIG. 26 is a timing chart of the scanning line driving circuit during full screen display in the conventional display device.
Figure 27:
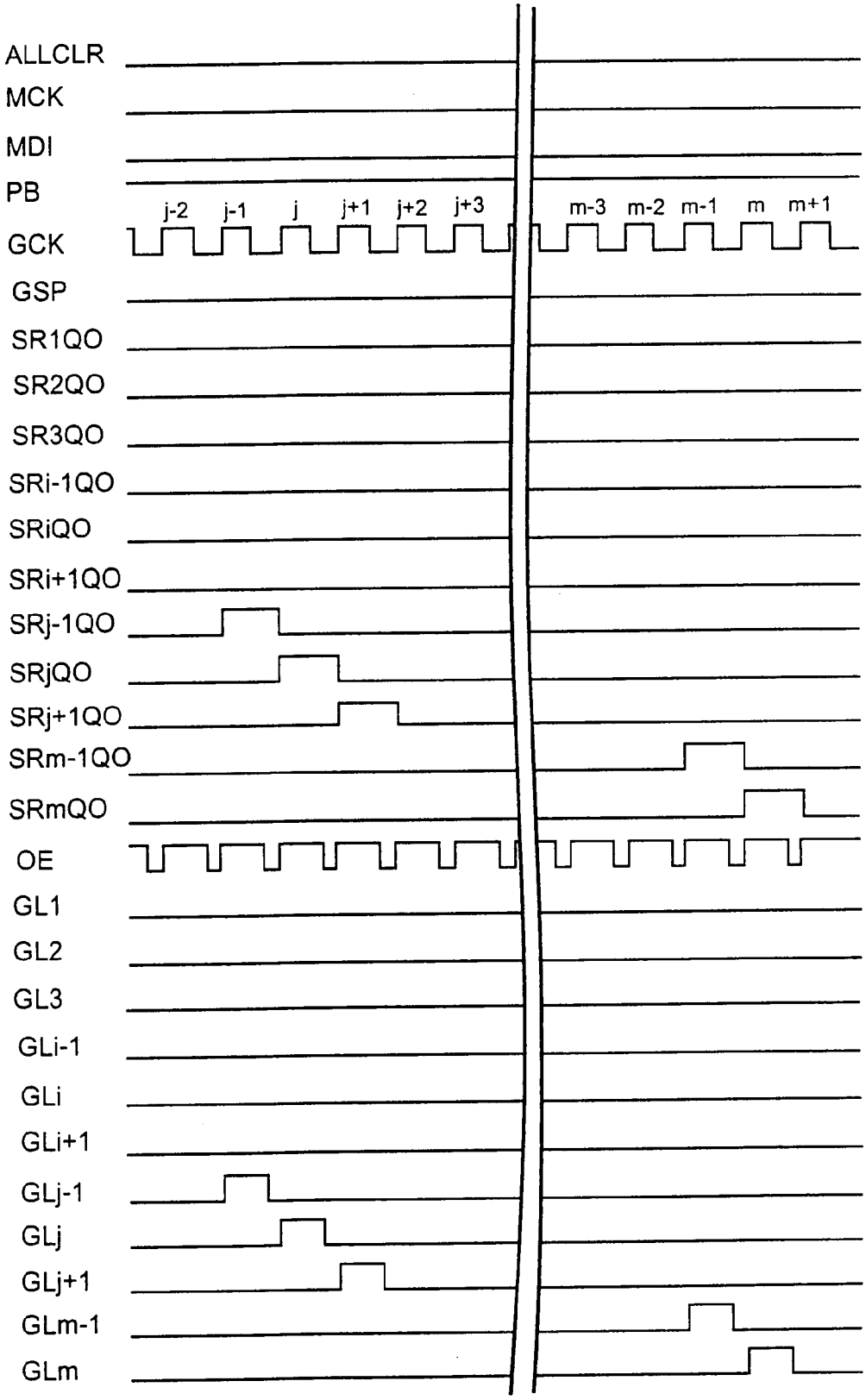
Fig.27 (Prior Art)
FIG. 27 is a timing chart of the scanning line driving circuit during full screen display in the conventional display device.
Figure 28:
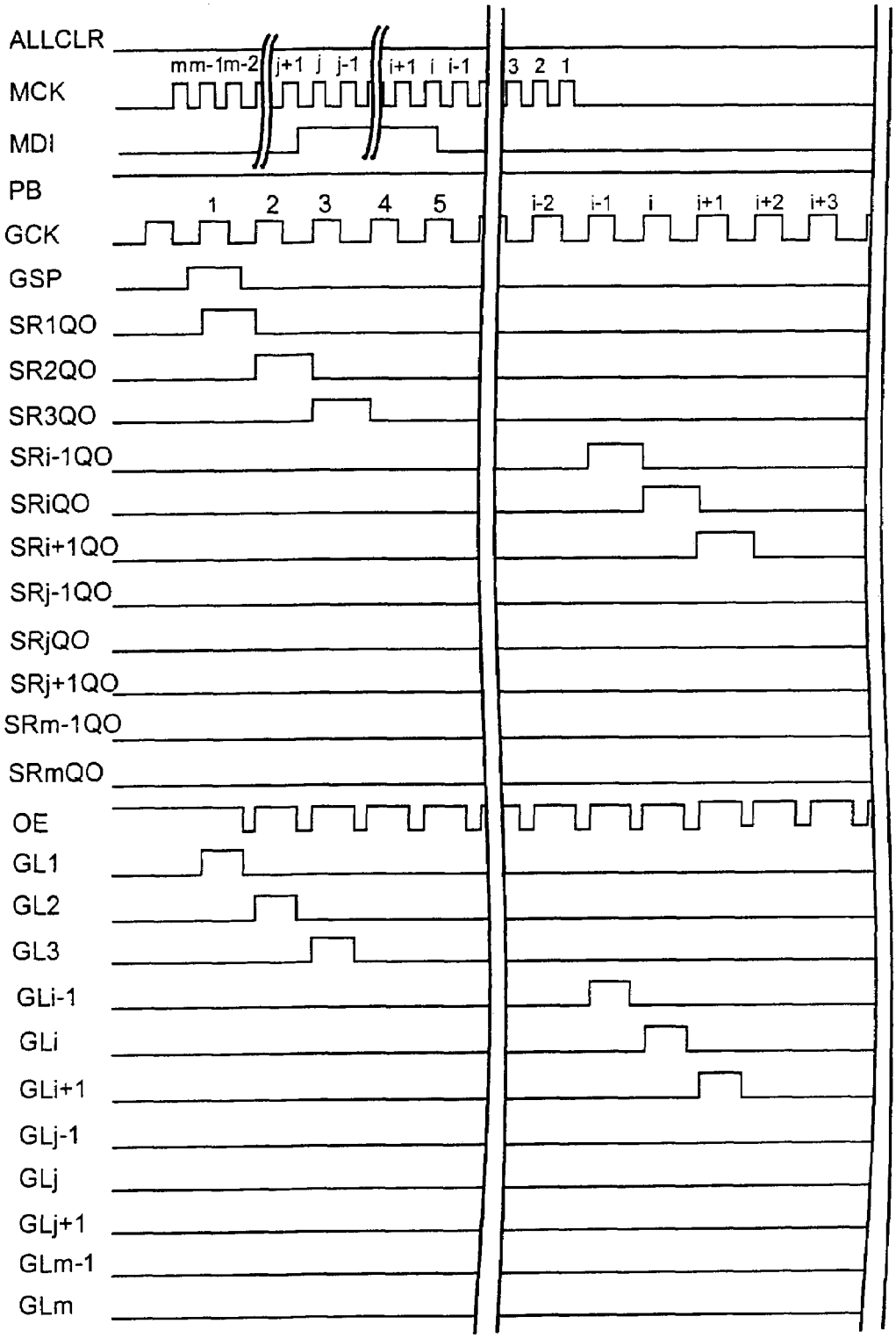
Fig.28 (Prior Art)
FIG. 28 is a timing chart of the scanning line driving circuit during the storage circuit setting for partial display.
Figure 29:
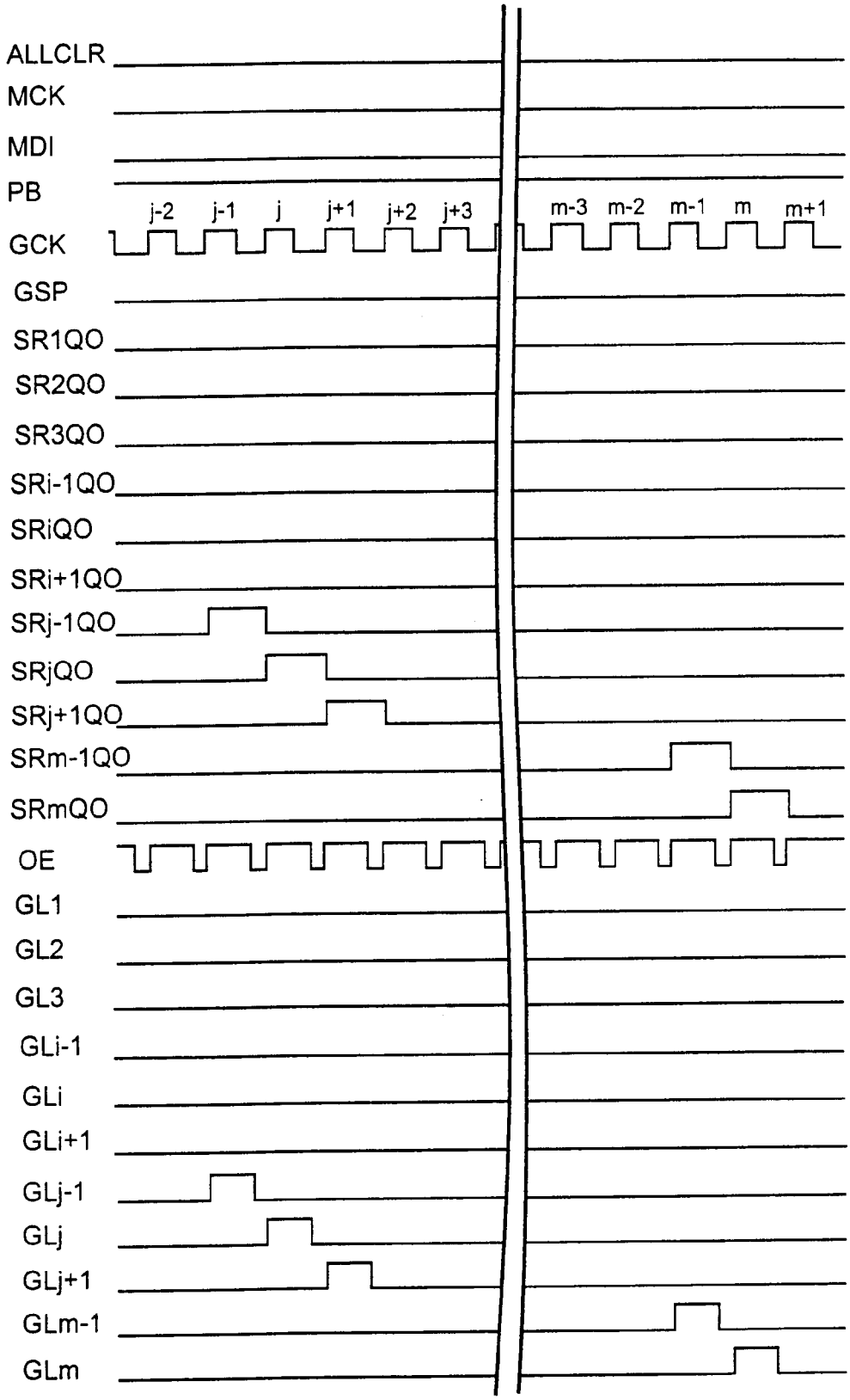
Fig.29 (Prior Art)
FIG. 29 is a timing chart of the scanning line driving circuit during the storage circuit setting for partial display.
Figure 30:
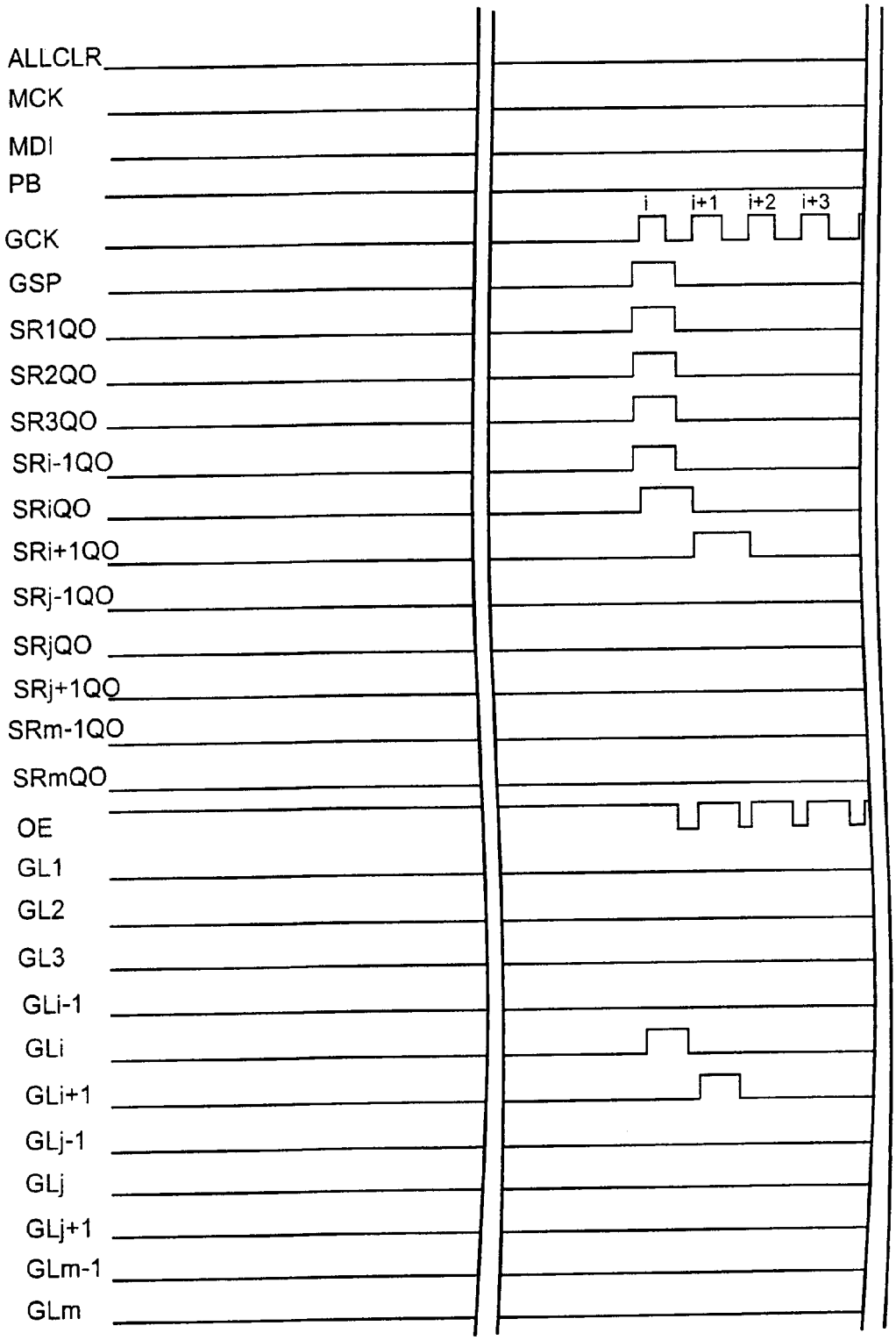
Fig.30 (Prior Art)
FIG. 30 is a timing chart of the scanning line driving circuit during partial display.
Figure 31:
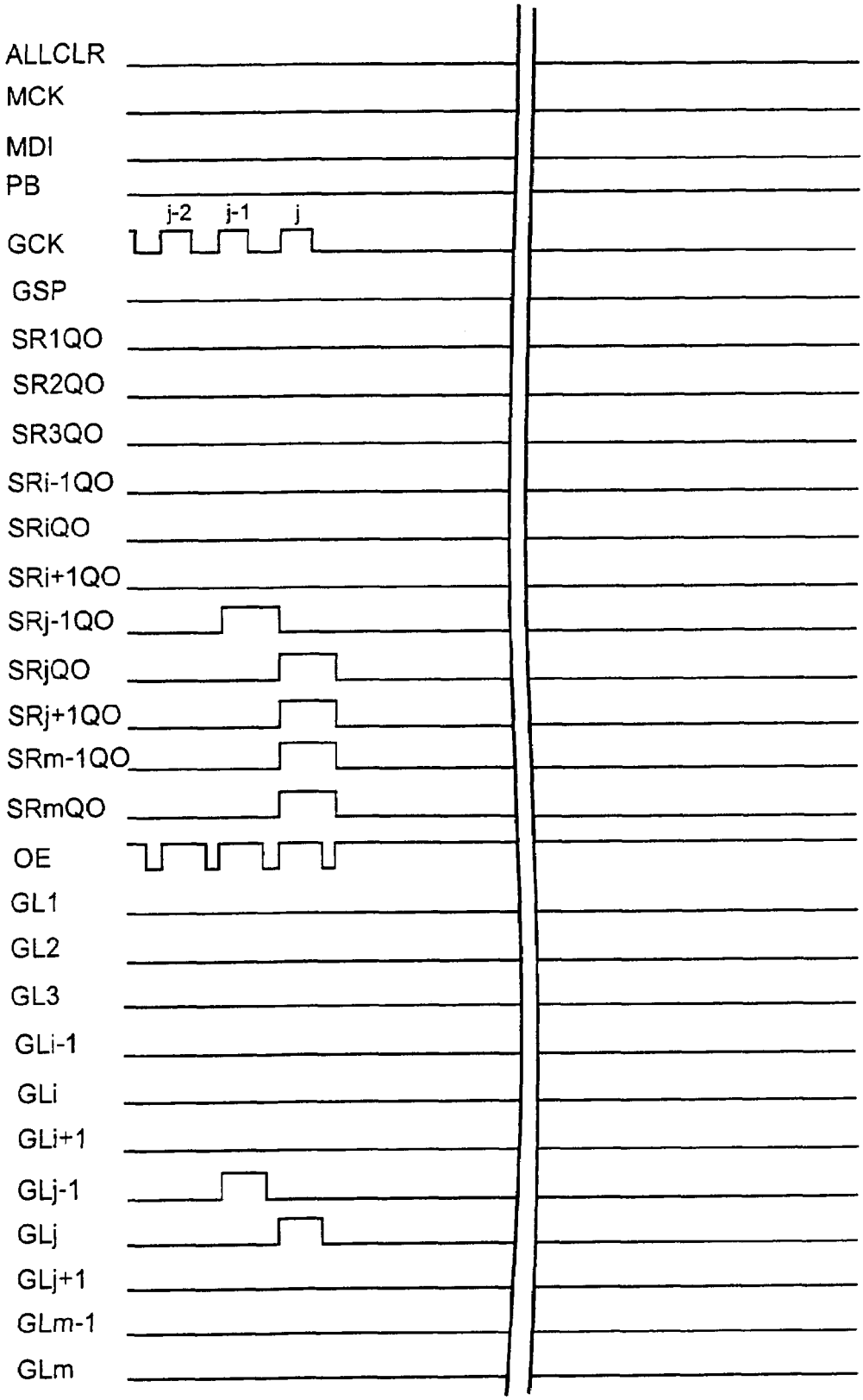
Fig.31 (Prior Art)
FIG. 31 is a timing chart of the scanning line driving circuit during partial display.

FIG. 22 is a timing chart of the scanning line driving circuit 32 according to this modification example. As shown in FIG. 22, when the input signal GSP is turned from Low to High, the D flip-flop circuits DFF1 and DFF2 are reset (DFF1Q and DFF2Q become Low). After this, when the input signal OE becomes High, the shift clock GCK1 becomes High. After this, also the shift clocks GCK2 to GCK4 sequentially become High.

With this modification example, after the input signal GSP has become High the shift clock which becomes High first is GCK 1. Therefore, in the case where the start position of the display region is the 1st, 5th, 9th, 13th, 17th . . . (4k−3)-th stage, partial display can be realized also with the shift clock generating circuits with the configuration shown in FIG. 21.

9 Further Considerations

In the foregoing embodiments, the shift register 40 of the present invention is applied to the scanning line driving circuit 32 of a display device, but the present invention is not limited to this. The shift register 40 of the present invention can also be applied to the signal line driving circuit 31 of a display device. In the signal line driving circuit 31, signals are generated by the shift register 40 such that the signal lines from the start position to the end position of the display region are driven, and the image signals DAT are sampled by the sampling circuit 38 based on these signals. In the foregoing embodiments, the scanning lines corresponding to the display region for partial display are sequentially driven at each vertical scanning period, but instead, the signal lines corresponding to the display region for partial display are sequentially driven in correspondence at each horizontal scanning period. Thus, the image datas obtained by sampling are outputted into the signal lines corresponding to the display region, and partial display is performed. Moreover, the shift register 40 of the present invention is suitably used for a display device, as described above, but it may also be applied to devices other than display devices.

Moreover, in the foregoing embodiment, an RS flip-flop circuit (set/reset flip-flop circuit) is provided in the bistable circuits, but the present invention is not limited to this. It is possible that a circuit is provided that has a set state and a reset state, that can be put into the set state or the reset state by applying a signal from outside, and that can hold that state.

While the invention has been described in detail, the foregoing description is in all aspects illustrative and not restrictive. It is understood that numerous other modifications and variations can be devised without departing from the scope of the invention.

This application claims priority upon Japanese Patent Application 2003-200564 titled "SHIFT REGISTER AND DISPLAY DEVICE," filed on Jul. 23, 2003, which is incorporated herein by reference.

What is claimed is:

1. A shift register comprising:

a plurality of bistable circuits connected in series, each of the bistable circuits having a first state and a second state and outputting a stage output signal of a logic level in accordance with the state of that bistable circuit, and all or some of the plurality of bistable circuits sequentially taking on the first state for a predetermined time each in accordance with a clock signal that is inputted from outside;

a start position setting circuit for keeping the bistable circuit at a start position, which is the bistable circuit specified by a start position instruction signal that is inputted from outside, in the first state; and a reset circuit for setting the bistable circuits other than the bistable circuit at the start position to the second state, after the bistable circuit at an end position, which is the bistable circuit specified by an end position instruction signal that is inputted from outside, has been set to the first state;

wherein, when the bistable circuit at the start position is kept at the first state, the bistable circuits from the start position to the end position are sequentially set to the first state for the predetermined time each in accordance with the clock signal.

2. The shift register according to claim 1, wherein the start position setting circuit keeps the bistable circuit at the start position in the first state by preventing the bistable circuit at the start position from taking on the second state.

3. The shift register of claim 1, wherein first, second and third of the bistable circuits are electrically connected to first, second and third scanning lines, respectively, the scanning lines extending across a substantial portion of a display device, so that outputs of the first, second and third bistable circuits are provided to the first, second, and third scanning lines, respectively, where each of the scanning lines controls a plurality of gates across the display device.

4. A shift register comprising:

a plurality of bistable circuits connected in series, each of the bistable circuits having a first state and a second state and outputting a stage output signal of a logic level in accordance with the state of that bistable circuit, and all or some of the plurality of bistable circuits sequentially taking on the first state for a predetermined time each in accordance with a clock signal that is inputted from outside;

a start position setting circuit for keeping the bistable circuit at a start position, which is the bistable circuit specified by a start position instruction signal that is inputted from outside, in the first state;

a reset circuit for setting the bistable circuits other than the bistable circuit at the start position to the second state, after the bistable circuit at an end position, which is the bistable circuit specified by an end position instruction signal that is inputted from outside, has been set to the first state;

wherein, when the bistable circuit at the start position is kept at the first state, the bistable circuits from the start position to the end position are sequentially set to the first state for the predetermined time each in accordance with the clock signal;

wherein a start signal that is set at a first logic level at a process start at every frame period, which is a cycle of partial driving in which the bistable circuits from the start position to the end position sequentially take on the first state for a predetermined time each in accordance with the clock signal, a start position setting signal for specifying the bistable circuit corresponding to the start position based on the start position instruction signal, and a final-stage reset signal for setting all bistable circuits except for the bistable circuit at the start position to the second state, are inputted from outside;

wherein the start position setting circuit comprises a first logic gate that is provided in each bistable circuit, the first logic gate outputting a signal of the first logic level when both the start position setting signal and a second-subsequent output signal that is outputted by the bistable circuit two stages after that bistable circuit are at the first logic level, and outputting a signal of a second logic level when at least one of the second-subsequent output signal and the start position setting signal is at the second logic level;

wherein the reset circuit comprises a second logic gate that is provided in each bistable circuit, the second logic gate outputting a signal of the first logic level when the final-stage reset signal and a prior-stage state signal that is set at the first or the second logic level depending on whether or not any of the bistable circuits arranged at the stages prior to that bistable circuit is in the first state are both at the first logic level, and outputting a signal of the second logic level when at least one of the prior-stage state signal and the final-stage reset signal is at the second logic level;

wherein each of the bistable circuits:

is set to the first state when the stage output signal that is outputted from the bistable circuit one stage prior to that bistable circuit is at the first logic level;

outputs a signal of the first logic level as the stage output signal of that bistable circuit when the start signal is at the first logic level or the bistable circuit one stage prior to that bistable circuit is in the first state, and that bistable circuit is in the first state, and the clock signal is at the first logic level;

outputs a signal of the first logic level as the prior-stage state signal to be received by the bistable circuit of the stage subsequent to that bistable circuit when the prior-stage state signal that is outputted from the bistable circuit one stage prior to that bistable circuit is at the first logic level, or that bistable circuit is in the first state; and is set to the second state when the first logic gate or the second logic gate within that bistable circuit outputs a signal of the first logic level.

5. The shift register according to claim 4, wherein the number of the phases of the clock signal is at least three.

6. A display device comprising a scanning line driving circuit for driving a plurality of scanning lines and a signal line driving circuit for driving a plurality of signal lines, the display device having a partial display function in which a portion of a display screen serves as a display region;

at least one of the scanning line driving circuit and the signal line driving circuit comprising a shift register; and the shift register comprising:

a plurality of bistable circuits connected in series, each of the bistable circuits having a first state and a second state and outputting a stage output signal of a logic level in accordance with the state of that bistable circuit, and all or some of the plurality of bistable circuits sequentially taking on the first state for a predetermined time each in accordance with a clock signal that is inputted into the shift register from outside the shift register;

a start position setting circuit for keeping the bistable circuit at a start position, which is the bistable circuit specified by a start position instruction signal that is inputted from outside, in the first state; and a reset circuit for setting the bistable circuits other than the bistable circuit at the start position to the second state, after the bistable circuit at an end position, which is the bistable circuit specified by an end position instruction signal that is inputted into the shift register from outside the shift register, has been set to the first state;

wherein, when the bistable circuit at the start position is kept at the first state, the bistable circuits from the start position to the end position are sequentially set to the first state for the predetermined time each in accordance with the clock signal.

7. The device of claim 6, wherein at least one of the bistable circuits comprises a first logic gate that outputs a first logic level signal when both a start position setting signal and a second subsequent output signal that is outputted by the bistable circuit two stages after that bistable circuit are at the first logic level, and outputs a second logic level signal of a different logic level when at least one of the second subsequent output signal and the start position setting signal is at the second logic level.

8. The display device according to claim 6, wherein the start position setting circuit keeps the bistable circuit at the start position in the first state by preventing the bistable circuit at the start position from taking on the second state.

9. A display device comprising a scanning line driving circuit for driving a plurality of scanning lines and a signal line driving circuit for driving a plurality of signal lines, the display device having a partial display function in which a portion of a display screen serves as a display region;

at least one of the scanning line driving circuit and the signal line driving circuit comprising a shift register; and the shift register comprising:

a plurality of bistable circuits connected in series, each of the bistable circuits having a first state and a second state and outputting a stage output signal of a logic level in accordance with the state of that bistable circuit, and all or some of the plurality of bistable circuits sequentially taking on the first state for a predetermined time each in accordance with a clock signal that is inputted into the shift register from outside the shift register;

a start position setting circuit for keeping the bistable circuit at a start position, which is the bistable circuit specified by a start position instruction signal that is inputted from outside, in the first state; and a reset circuit for setting the bistable circuits other than the bistable circuit at the start position to the second state, after the bistable circuit at an end position, which is the bistable circuit specified by an end position instruction signal that is inputted into the shift register from outside the shift register, has been set to the first state;

wherein, when the bistable circuit at the start position is kept at the first state, the bistable circuits from the start position to the end position are sequentially set to the first state for the predetermined time each in accordance with the clock signal;

wherein a start signal that is set at a first logic level at a process start at every frame period, which is a cycle of partial driving in which the bistable circuits from the start position to the end position sequentially take on the first state for a predetermined time each in accordance with the clock signal, a start position setting signal for specifying the bistable circuit corresponding to the start position based on the start position instruction signal, and a final-stage reset signal for setting all bistable circuits except for the bistable circuit at the start position to the second state, are inputted into the shift register from outside the shift register;

wherein the start position setting circuit comprises a first logic gate that is provided in each bistable circuit, the first logic gate outputting a signal of the first logic level when both the start position setting signal and a second-subsequent output signal that is outputted by the bistable circuit two stages after that bistable circuit are at the first logic level, and outputting a signal of a second logic level when at least one of the second-subsequent output signal and the start position setting signal is at the second logic level;

wherein the reset circuit comprises a second logic gate that is provided in each bistable circuit, the second logic gate outputting a signal of the first logic level when the final-stage reset signal and a prior-stage state signal that is set at the first or the second logic level depending on whether or not any of the bistable circuits arranged at the stages prior to that bistable circuit is in the first state are both at the first logic level, and outputting a signal of the second logic level when at least one of the prior-stage state signal and the final-stage reset signal is at the second logic level;

wherein each of the bistable circuits:

is set to the first state when the stage output signal that is outputted from the bistable circuit one stage prior to that bistable circuit is at the first logic level;

outputs a signal of the first logic level as the stage output signal of that bistable circuit when the start signal is at the first logic level or the bistable circuit one stage prior to that bistable circuit is in the first state, and that bistable circuit is in the first state, and the clock signal is at the first logic level;

outputs a signal of the first logic level as the prior-stage state signal to be received by the bistable circuit of the stage subsequent to that bistable circuit when the prior-stage state signal that is outputted from the bistable circuit one stage prior to that bistable circuit is at the first logic level, or that bistable circuit is in the first state; and is set to the second state when the first logic gate or the second logic gate within that bistable circuit outputs a signal of the first logic level.

10. The display device according to claim 9, wherein the number of the phases of the clock signal is at least three.

11. The display device according to claim 9, further comprising:

a start position setting signal generating circuit for outputting a signal of the second logic level as the start position setting signal when the stage output signal that is outputted from the bistable circuit two stages after bistable circuit at the start position is at the first level; and a final-stage reset signal generating circuit for outputting a signal of the first logic level as the final-stage reset signal when the stage output signal that is outputted from bistable circuit at the end position changes from the first logic level to the second logic level.

* * * * *